US006283108B1

(12) United States Patent
Matsufuji et al.

(10) Patent No.: US 6,283,108 B1
(45) Date of Patent: Sep. 4, 2001

(54) FUEL INJECTION CONTROL ARRANGEMENT FOR INTERNAL COMBUSTION ENGINE WITH ABNORMALITY DETECTION FUNCTION THEREIN

(75) Inventors: Koji Matsufuji; Toshio Hori, both of Hitachinaka; Masahiro Toyohara, Hitachioota; Kenichi Goto, Zama, all of (JP)

(73) Assignees: Hitachi, Ltd., Tokyo; Nissan Motor Co., Ltd., Yokohama, both of (JP)

( * ) Notice: Subject to any disclaimer, the term of this patent is extended or adjusted under 35 U.S.C. 154(b) by 0 days.

(21) Appl. No.: 09/386,955

(22) Filed: Aug. 31, 1999

(30) Foreign Application Priority Data

Aug. 31, 1998 (JP) ..... 10-246311

(51) Int. Cl.[7] ..... F02D 41/22
(52) U.S. Cl. ..... 123/690; 123/458; 123/479
(58) Field of Search ..... 123/198, 458, 123/479, 690

(56) References Cited

U.S. PATENT DOCUMENTS 6,012,438 * 1/2000 Joos et al. ..... 123/690
6,032,639 * 3/2000 Goto et al. ..... 123/690 X
6,138,638 * 10/2000 Morikawa ..... 123/690 X

FOREIGN PATENT DOCUMENTS 10-47144 2/1998 (JP) .

* cited by examiner

*Primary Examiner*—Tony M. Argenbright
(74) *Attorney, Agent, or Firm*—Crowell & Moring LLP

(57) ABSTRACT

A control arrangement for an internal combustion engine which includes a fuel supply system, an air/fuel ratio control system, an abnormality diagnoser which diagnoses a possible abnormality in the fuel supply system, when the pressure of the pressurized fuel in the fuel supply system detected by a fuel pressure senor exceeds predetermined upper and lower limits determined by a control duty for an electrically controlled pressure regulator, and an abnormal element decider which decides an abnormality either in the fuel pressure sensor or in the electrically controlled pressure regulator based on an amount representing an air/fuel ratio status including the actual air/fuel ratio and the air/fuel ratio feed back control amount extracted from the air/fuel ratio control system for the internal combustion engine, when the abnormality diagnoser diagnoses an abnormality in the fuel supply system.

6 Claims, 19 Drawing Sheets

FUEL INJECTION CONTROL ARRANGEMENT FOR INTERNAL COMBUSTION ENGINE WITH ABNORMALITY DETECTION FUNCTION THEREIN

BACKGROUND OF THE INVENTION

1. Field of the Invention

The present invention relates to a fuel injection control arrangement for an internal combustion engine, in particular, to a fuel injection control arrangement for an internal combustion engine capable of detecting abnormality of a fuel pressure control means and/or fuel pressure detection means in the arrangement.

2. Conventional Art

When an internal combustion engine is operated under a condition of superlean air/fuel ratio, for example, 30~100 with respect to stoichiometric air/fuel ratio of 14.7, an extreme improvement in fuel economy and in exhaust gas clarification performance can be achieved, however, in order for operating the internal combustion engine at such superlean air/fuel ratio a highly pressurized fuel is necessary. In an operation of an internal combustion engine, a predetermined constant fuel pressure is frequently employed. However, in order to achieve a sufficient combustion performance it is preferable to vary the fuel pressure, for example, it is preferable to control the fuel pressure between 5 MPa and 10 MPa depending upon operation modes of an internal combustion engine concerned. For the purpose of this fuel pressure control, an electrically controllable pressure regulator for regulating the fuel pressure and a fuel pressure sensor for detecting the fuel pressure are used. However, in case when one of the electrically controllable fuel pressure regulator and the fuel pressure sensor fails, there poses a problem that the fuel pressure is placed out of control.

JP-A-10-47144 (1998), for example, discloses an abnormality diagnosis device for a fuel supply and injection arrangement which detects abnormality in fuel pressure and performs an abnormality diagnosis in the arrangement, wherein the abnormality diagnosis device for the fuel supply and injection arrangement, which includes a fuel pressurizing pump for pressurizing fuel in order to inject the pressurized fuel from a fuel injection nozzle into an internal combustion engine, a solenoid valve for adjusting amount of fuel to be fed and injected from the fuel injection nozzle into the internal combustion engine and a solenoid control means for outputting driving signals for the solenoid valve so as to control the amount of fuel at a predetermined amount, the abnormality diagnosis device is provided with a fuel pressure detection means for detecting the fuel pressure and an abnormality judging means of the solenoid valve based on variation of fuel pressure after being outputted of a valve open signal to the solenoid valve from the solenoid control means.

When an abnormal increase or decrease in fuel pressure in the fuel supply and injection arrangement or system for an internal combustion engine is detected, a failure which deteriorates an operating performance of the internal combustion engine can generally be discovered, however, a possible cause of the failure can not be judged by the detection of the fuel pressure abnormality. Further, if it is erroneously diagnosed as a failure, a corresponding element is erroneously exchanged.

SUMMARY OF THE INVENTION

In view of the above conventional art problems, one of the objects of the present invention is that when such as means for controlling fuel pressure and means for detecting fuel pressure are failed, abnormality thereby are detected immediately and in addition a possible failure element causing the abnormality is identified.

Another object of the present invention is that in response to the identification of a failed element a control amount of the fuel pressure control means is varied so as to continue control for the internal combustion engine.

Still another object of the present invention is that when the failed element is restored, the abnormality detection is cleared and the operation returns to a normal one, thereby the erroneous element exchange is prevented.

The above objects of the present invention are achieved by a control arrangement for an internal combustion engine, which comprises means for pressurizing fuel to be fed and injected into the internal combustion engine, the fuel pressure being one of parameters of determining amount of fuel; means for controlling the fuel pressure; means for detecting the fuel pressure; means for detecting an operating condition of the internal combustion engine; means for determining a target air/fuel ratio for the internal combustion engine depending on the detected operating condition of the internal combustion engine; means for detecting air/fuel ratio of the internal combustion engine; and an air/fuel ratio feed back control means for feeding back a feed back control amount depending on a deviation between the determined target air/fuel ratio and the detected air/fuel ratio, and which control arrangement further comprises an abnormality detection means which detects abnormality either in the fuel pressure control means or in the fuel pressure detection means when the fuel pressure detected by the fuel pressure detection means for the internal combustion engine is judged outside a predetermined range determined by a control amount fed for the fuel pressure control means, and performs a control for the internal combustion engine other than a normal control when the abnormality detection means detects an abnormality.

Further, the above objects of the present invention are achieved by the control arrangement for an internal combustion engine which uses a signal representing an air/fuel ratio status amount determined by making use of the air/fuel ratio for the internal combustion engine for detecting an abnormality either in the fuel pressure control means or in the fuel pressure detection means, and through detection whether or not the signal is within a predetermined range an abnormal element causing the abnormality is specified.

One aspect of the present invention is to provide a control arrangement for an internal combustion engine which comprises a fuel supply system for an internal combustion engine including means for pressurizing fuel to be fed and injected into the internal combustion engine, the fuel pressure being one of parameters of determining amount of fuel; means for controlling the fuel pressure; and means for detecting the fuel pressure; means for detecting an operating condition of the internal combustion engine; means for determining a target air/fuel ratio for the internal combustion engine depending on the detected operating condition of the internal combustion engine; means for detecting air/fuel ratio of the internal combustion engine; and an air/fuel ratio feed back control means for feeding back a feed back control amount determined by relating to a deviation between the determined target air/fuel ratio and the detected air/fuel ratio, and which control arrangement further comprises an abnormality diagnosis means for diagnosing abnormality in the fuel supply system based on the fuel pressure detected by the fuel pressure detection means and an abnormal element detection means for detecting a possible abnormal element in the fuel supply system based on an amount representing an air/fuel ratio status including the detected air fuel ratio and the air/fuel ratio feed back control amount when the abnormality diagnosis means diagnoses an abnormality in the fuel supply system.

Further, the present invention provides the control arrangement for an internal combustion engine in which the abnormality diagnosis means diagnoses an abnormality in the fuel supply system when the fuel pressure detected by the fuel pressure detection means for the internal combustion engine is judged outside a predetermined range determined by a control amount fed for the fuel pressure control means.

Still further, the present invention provides the control arrangement for an internal combustion engine in which the abnormal element detection means detects a possible abnormal element through detection whether or not the actual air/fuel ratio detected by the air/fuel ratio detection means for the internal combustion engine is within a predetermined range of the target air/fuel ratio determined based on the operating condition of the internal combustion engine.

Still further, the present invention provides the control arrangement for an internal combustion engine in which the abnormal element detection means detects a possible abnormal element through detection whether or not the feed back control amount fed back from the air/fuel ratio feed back control means is within a predetermined range.

Another aspect of the present invention is to provide a control arrangement for an internal combustion engine which comprises a fuel supply system for an internal combustion engine including means for pressurizing fuel to be fed and injected into the internal combustion engine, the fuel pressure being one of parameters of determining amount of fuel; means for controlling the fuel pressure; and means for detecting the fuel pressure; means for detecting an operating condition of the internal combustion engine; means for determining a target air/fuel ratio for the internal combustion engine depending on the detected operating condition of the internal combustion engine; means for detecting air/fuel ratio of the internal combustion engine; and an air/fuel ratio feed back control means for feeding back a feed back control amount determined by relating to a deviation between the determined target air/fuel ratio and the detected air/fuel ratio, and which control arrangement further comprises an abnormality diagnosis means for diagnosing abnormality in the fuel supply system based on the fuel pressure detected by the fuel pressure detection means and a control amount fixing means for feeding a fixed control amount for the fuel pressure control means, when the abnormality diagnosis means diagnoses an abnormality in the fuel supply system.

Further, the present invention provides the control arrangement for an internal combustion engine in which the abnormality diagnosis means diagnoses an abnormality in the fuel supply system when the fuel pressure detected by the fuel pressure detection means for the internal combustion engine is judged outside a predetermined range determined by a control amount fed for the fuel pressure control means.

Still further, the present invention provides the control arrangement for an internal combustion engine in which the control amount fixing means feeds as the fixed control amount either zero or full control amount to the fuel pressure control means.

Still further, the present invention provides the control arrangement for an internal combustion engine in which the control amount fixing means feeds as the fixed control amount in an alternative manner large and small two control amounts to the fuel pressure control means.

Still another aspect of the present invention is to provide a control arrangement for an internal combustion engine which comprises a fuel supply system for an internal combustion engine including means for pressurizing fuel to be fed and injected into the internal combustion engine, the fuel pressure being one of parameters of determining amount of fuel means for controlling the fuel pressure; and means for detecting the fuel pressure; means for detecting an operating condition of the internal combustion engine; means for determining a target air/fuel ratio for the internal combustion engine depending on the detected operating condition of the internal combustion engine; means for detecting air/fuel ratio of the internal combustion engine; and an air/fuel ratio feed back control means for feeding back a feed back control amount determined by relating to a deviation between the determined target air/fuel ratio and the detected air/fuel ratio, and which control arrangement further comprises an abnormality diagnosis means for diagnosing abnormality in the fuel supply system based on the fuel pressure detected by the fuel pressure detection means and a normality judge means which forcedly varies the control amount fed for the fuel pressure control means when the abnormality diagnosis means diagnoses an abnormality in the fuel supply system, detects whether or not the fuel pressure determined by the forcedly varied control amount is within a predetermined range, and judges normality of the fuel supply system if the detected fuel pressure is within the predetermined range.

Further, the present invention provides the control arrangement for an internal combustion engine in which the normality judge means forcedly varies the control amount either in zero control amount, in full control amount or in large and small alternating two control amounts.

Further aspect of the present invention is to provide a control method for a control arrangement for an internal combustion engine which control arrangement comprises a fuel supply system for an internal combustion engine including means for pressurizing fuel to be fed and injected into the internal combustion engine, the fuel pressure being one of parameters of determining amount of fuel; means for controlling the fuel pressure; and means for detecting the fuel pressure; means for detecting an operating condition of the internal combustion engine; means for determining a target air/fuel ratio for the internal combustion engine depending on the detected operating condition of the internal combustion engine; means for detecting air/fuel ratio of the internal combustion engine; and an air/fuel ratio feed back control means for feeding back a feed back control amount determined by relating to a deviation between the determined target air/fuel ratio and the detected air/fuel ratio, and which control method comprises the step of detecting abnormality in the fuel supply system based on the fuel pressure in the fuel supply system detected by the fuel pressure detection means; the step of determining whether the air/fuel ratio signal from the air/fuel ratio detection means sticks to a lean state or at a rich state; the step of controlling the air/fuel ratio in such a manner that when a sticking to a lean state is detected the air/fuel ratio is controlled into a rich state and when a sticking to a rich state is detected the air/fuel ratio is controlled into a lean state so as to continue an operation of the internal combustion engine.

Further aspect of the present invention is to provide a control arrangement for an internal combustion engine which comprises a fuel supply system for supplying and injecting a high pressure fuel into the internal combustion engine and including a high pressure fuel pump, an electrically controlled pressure regulator and a fuel pressure sensor which are disposed along a fuel supply line from a fuel tank to a fuel injection valve; and an air/fuel ratio control system including means for determining a target air/fuel ratio for the internal combustion engine in response to an operating condition of the internal combustion engine, an air/fuel ratio sensor for detecting an air/fuel ratio of the internal combustion engine, and an air/fuel ratio feed back control means for feeding back a control amount determined in relation to a deviation between the determined target air/fuel ratio and the detected air/fuel ratio, and which control arrangement further comprises an abnormality diagnosis means which diagnoses a possible abnormality in the fuel supply system, when the pressure of the pressurized fuel in the fuel supply system detected by the fuel pressure sensor exceeds beyond predetermined upper and lower limits determined by a control duty for the electrically controlled pressure regulator; and an abnormal element decision means which decides an abnormal element in the fuel supply system at least an abnormality either in the fuel pressure sensor or in the electrically controlled pressure regulator based on an amount representing an air/fuel ratio status including the actual air/fuel ratio and the air/fuel ratio feed back control amount extracted from the air/fuel ratio feed back control system for the internal combustion engine, when the abnormality diagnosis means diagnoses an abnormality in the fuel supply system.

DETAILED DESCRIPTION OF EMBODIMENTS

Figure 1:
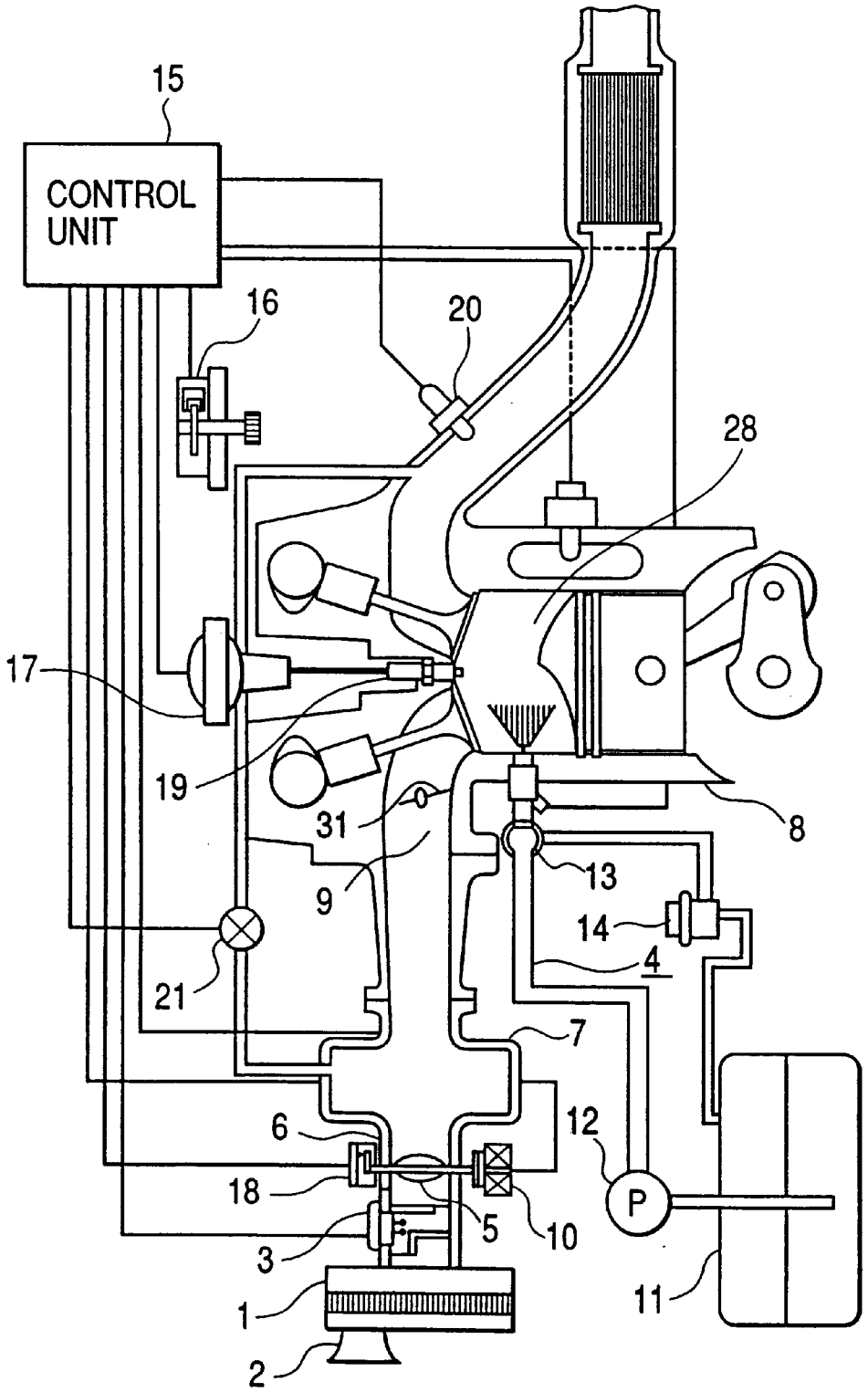
FIG. 1 shows an example of a system diagram of a fuel supply and injection arrangement for an internal combustion engine to which the present invention is applied.

Hereinbelow a control arrangement for an internal combustion engine according to the present invention is explained with reference to embodiments thereof shown in the drawings.

FIG. 1 shows an example of engine systems for an internal combustion engine to which the present invention is applied. In the system shown in FIG. 1, air to be taken-in into an engine 8 is taken-in from an inlet port 2 of an air cleaner 1, passes through a throttle body 6 where a throttle valve 5 for controlling amount of taken-in air is disposed, and is introduced into a collector 7. The throttle valve 5 is coupled with a motor 10 for driving the throttle valve 5, and through the driving of the motor 10 the throttle valve 5 is operated. Through the operation of the throttle valve 5 the amount of intake air is controlled. The intake air arrived at the collector 7 is distributed into respective intake conduits 9 each connected to a corresponding engine cylinder 28, and is introduced into the respective engine cylinders 28. The respective intake air conduits 9 each are provided with a swirl control valve 31 therein so as to apply a swirling force onto the intake air. The intake air applied of the swirling force is mixed with injected fuel in a form of mist in the respective cylinders 28 of the engine 8 which will be explained later.

Figure 2:
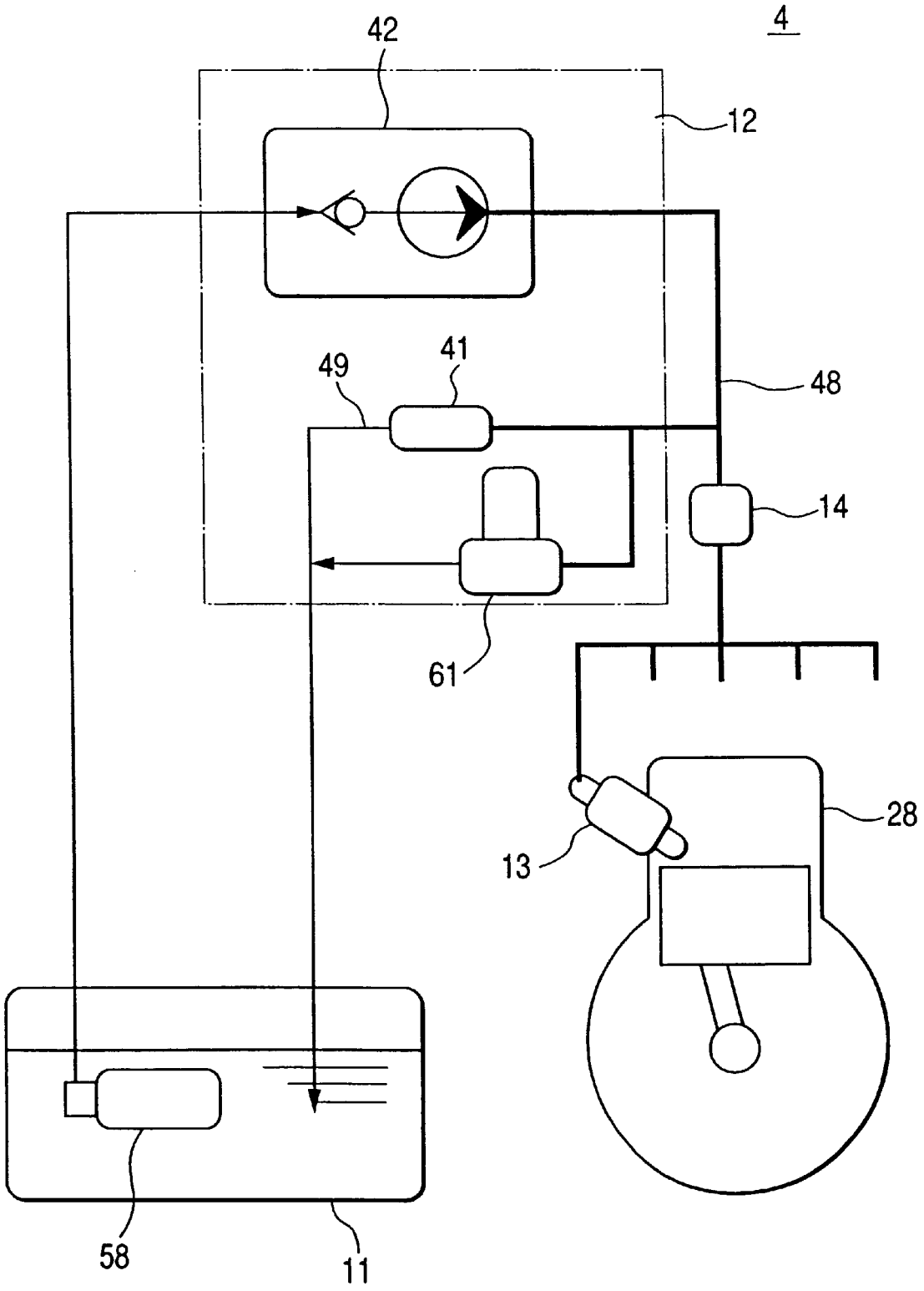
FIG. 2 shows an example of a fuel supply and injection arrangement constituting a fuel supply system for an internal combustion engine to which the present invention is applied.

FIG. 2 shows a fuel supply system in the engine system. As illustrated in FIG. 2, fuel such as gasoline is sucked from a fuel tank 11 by a low pressure fuel pump 58 and pressurized by a high pressure fuel pump 12, thereafter, is supplied to a fuel supply system 4 pipelining an electrically controlled pressure regulator 41, a fuel pressure sensor 14 and a fuel injection valve 13 therein.

The pressure of the fuel in the fuel supply system 4 is regulated at a predetermined pressure by the electrically controlled pressure regulator 41 which will be explained in detail with reference to FIGS. 3 and 4, and the pressure regulated fuel is injected into the respective cylinders 28 from the respective fuel injection valves 13 each of which fuel injection port opens into the corresponding cylinder 28.

The fuel pressure in the fuel pipeline from the high pressure fuel pump 12 to the fuel injection valves 13 is generally controlled by the electrically controlled pressure regulator 41. However, in case when no control amount is provided to a control system of the electrically controlled pressure regulator 41 or in case when the control system of the electrically controlled pressure regulator 41 is rendered inoperable, the fuel pressure in the fuel supply system is adjusted by a mechanical pressure regulator 61.

In FIG. 1, the fuel injected from each of the fuel injection valves 13 is fired by an ignition plug 19 with an ignition signal of a high voltage elevated by an ignition coil 17.

From an air flow meter 7 a signal representing intake air flow rate is outputted and is inputted into a control unit 15.

A throttle sensor 18 which is designed to detect an opening degree of the throttle valve 5 is mounted on the throttle body 6, and outputs of the throttle sensor 18 are also inputted into the control unit 15.

Numeral 16 is a crank-angle sensor which is rotatably driven by a cam shaft and outputs signals representing rotary positions of a crank shaft with an accuracy in the order of at least 1~4°. These signals are also inputted into the control unit 15. With these variety of input signals the control unit 15 controls fuel injection timing and ignition timing.

Numeral 20 is an A/F sensor disposed in an exhaust gas conduit which detects an actual air/fuel ratio from contents in the exhaust gas and outputs the corresponding signal to the control unit 15 as one of inputs therefor.

The control unit 15 receives as its inputs signals from a variety of sensors detecting operating conditions of the engine, performs predetermined calculation processings, outputs a variety of control signals calculated as a result of the processings, in that, outputs predetermined control signals such as to the fuel injection valves 13, the ignition coils 17 and the throttle valve actuating motor 10, and performs a fuel supply control, an ignition timing control and an intake air amount control.

Numeral 21 is an EGR valve of which signal representing opening degree is also inputted into the control unit 15.

In FIG. 2, fuel fed from the low pressure fuel pump 58 disposed in the fuel tank 11 is pressurized at a pump unit 42 in the high pressure fuel pump 12 to a high pressure exceeding 10MPa. The highly pressurized fuel is fed to the fuel injection valves 13, however, before the feeding the fuel pressure is controlled by the electrically controlled pressure regulator 41 through adjustment of returning fuel amount into the fuel tank 11. The fuel pressure is measured by the fuel pressure sensor 14 and is adjusted and controlled by the electrically controlled pressure regulator 41 at a predetermined fuel pressure.

Figure 3:
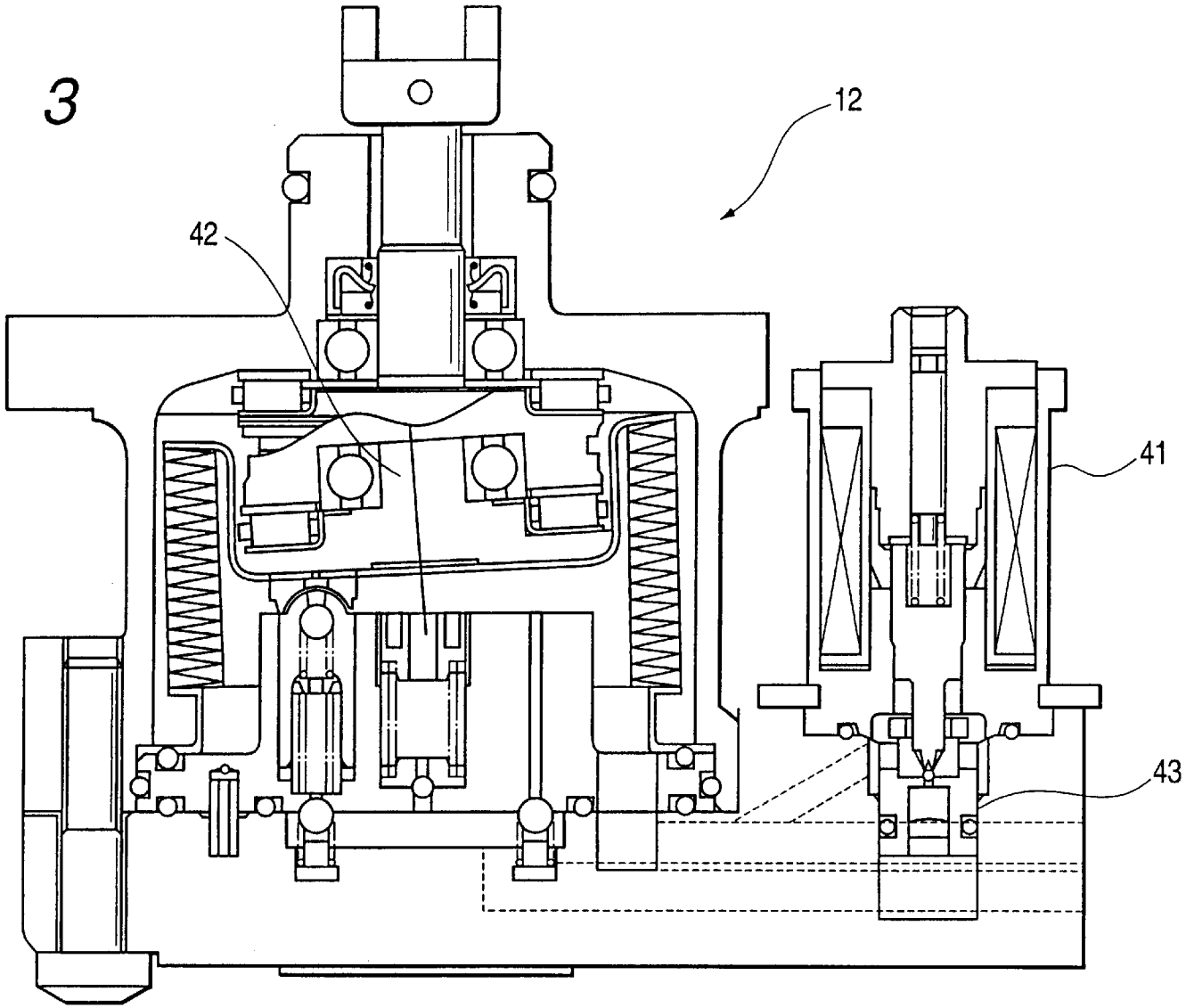
FIG. 3 shows a structure of a high pressure fuel pump and an electrically controlled pressure regulator in a fuel supply and injection arrangement to which the present invention is applied.

FIG. 3 shows a structure of the high pressure fuel pump, the entirety of which is designated by numeral 12 as in FIG. 2, the pump unit 42 is a piston-plunger type and through reciprocating movement of the piston the pressure of the fuel is elevated. On the other hand, the electrically controlled pressure regulator 41 functions by being applied to its coils of a control duty signal from the control unit 15 which will be explained later. A valve unit 43 of the electrically controlled pressure regulator 41 will be explained in further detail with reference to FIG. 4 below.

Figure 4:
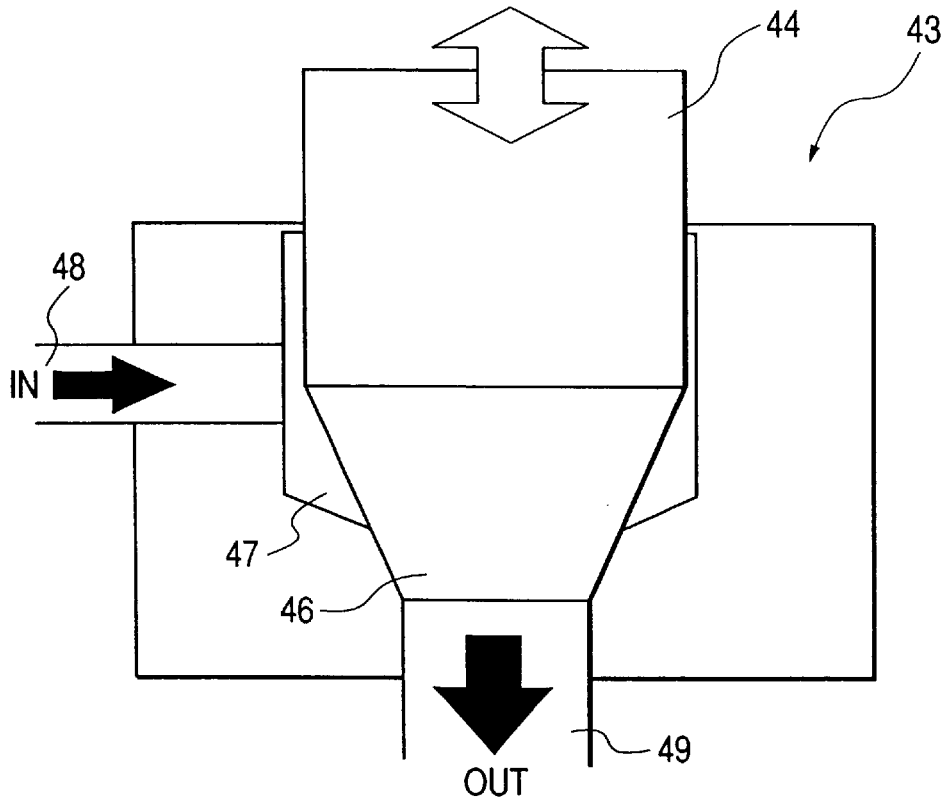
FIG. 4 shows a structure of a valve portion of the electrically controlled pressure regulator as shown in FIG. 3.

FIG. 4 shows the valve unit 43 in the electrically controlled pressure regulator 41 and is constituted by a plunger 44, a valve 46 and a valve seat 47. The valve unit 43 is structured in such a manner that the fuel in a fuel pipeline 48 flows into the valve unit 43 at IN side in the drawing and is discharged from a fuel pipeline 49 at OUT side in the drawing. When no control duty signal is provided from the control unit 15 to the electrically controlled pressure regulator 41, the valve 46 in the valve unit 43 is pushed onto the valve seat 47 with a spring (not shown), and no fuel from the fuel pipeline 48 at the IN side is discharged to the fuel pipeline 49 at the OUT side, therefore, the fuel pressure in the fuel pipeline 48 leading to the fuel injection valves 13 increases.

Figure 5:
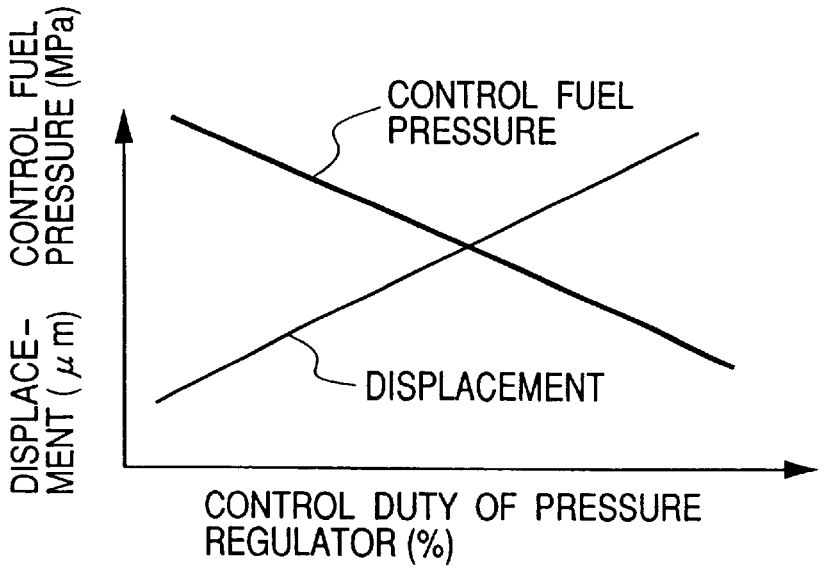
FIG. 5 shows an example of operation characteristics of the electrically controlled pressure regulator as shown in FIG. 3.

FIG. 5 shows an example of operating characteristics of the electrically controlled pressure regulator 41, in that, the position of plunger 44 of the electrically controlled pressure regulator 41 varies as shown in "DISPLACEMENT" in the drawing based on the control duty signals provided to the driving coils thereof from the control unit 15. Namely, with the control duty signal a pulling force to the plunger 44 is controlled and thus an escaping fuel amount from the valve 46 is controlled, thereby, the fuel pressure in the fuel pipeline 48 is controlled at a target fuel pressure. For example, FIG. 5 diagram shows when a magnitude of the control duty signal is large, the amount of displacement of the plunger 44 becomes large and the escaping fuel amount from the fuel pipeline 48 increases, thereby, the fuel pressure decreases.

Now, control of the electrically controlled pressure regulator 41 is explained with reference to FIGS. 6 and 7.

Figure 6:
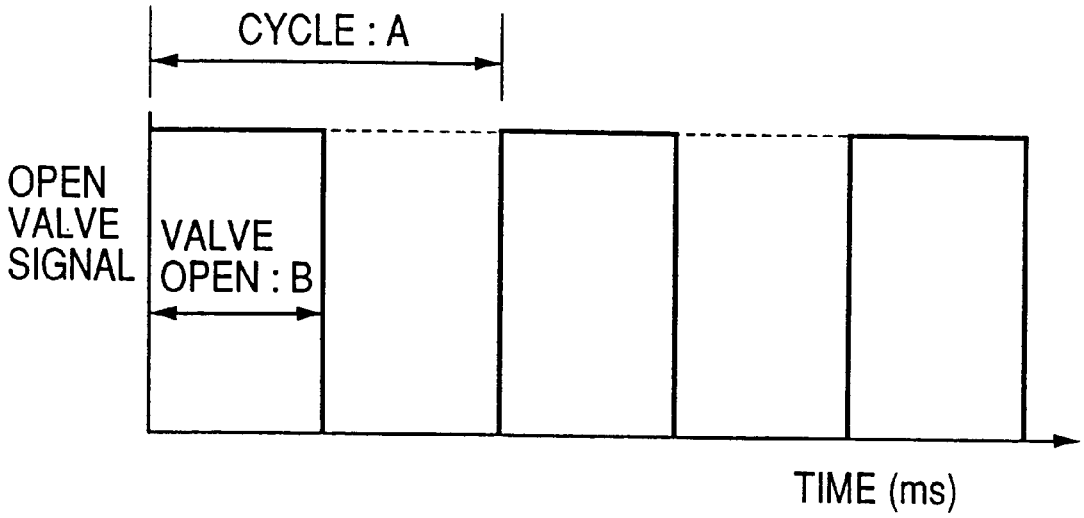
FIG. 6 shows an example of a control duty signal provided for the electrically controlled pressure regulator as shown in FIG. 3.

FIG. 6 is for explaining the control duty for the electrically controlled pressure regulator 41. The control duty of the electrically controlled pressure regulator 41 represents a ratio of an open valve interval with respect to a control cycle of the electrically controlled pressure regulator 41, for example, when assuming that the control cycle of the electrically controlled pressure regulator 41 is A and the current conducting internal through the coils of the electrically controlled pressure regulator 41 is B, the control duty is defined as B/A (%).

Figure 7:
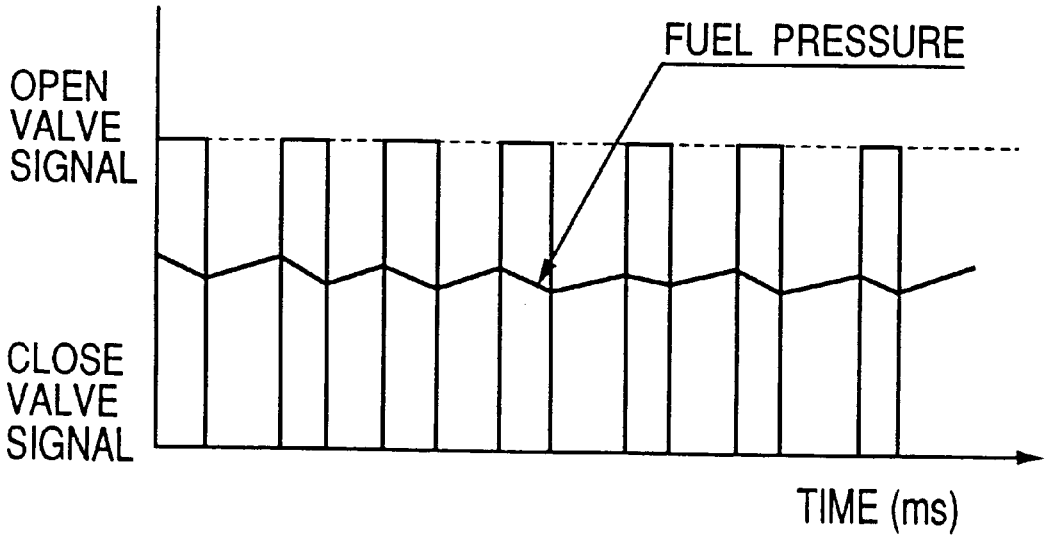
FIG. 7 shows an example of operations of the electrically controlled pressure regulator as shown in FIG. 3 based on a control duty signal provided thereto.

FIG. 7 shows an observed fuel pressure in the fuel pipeline 48 under the above indicated control duty of B/A (%) wherein the fuel pressure fluctuates in synchronism with the current conducting interval B flowing through the coils of the electrically controlled pressure regulator 41.

Figure 8:
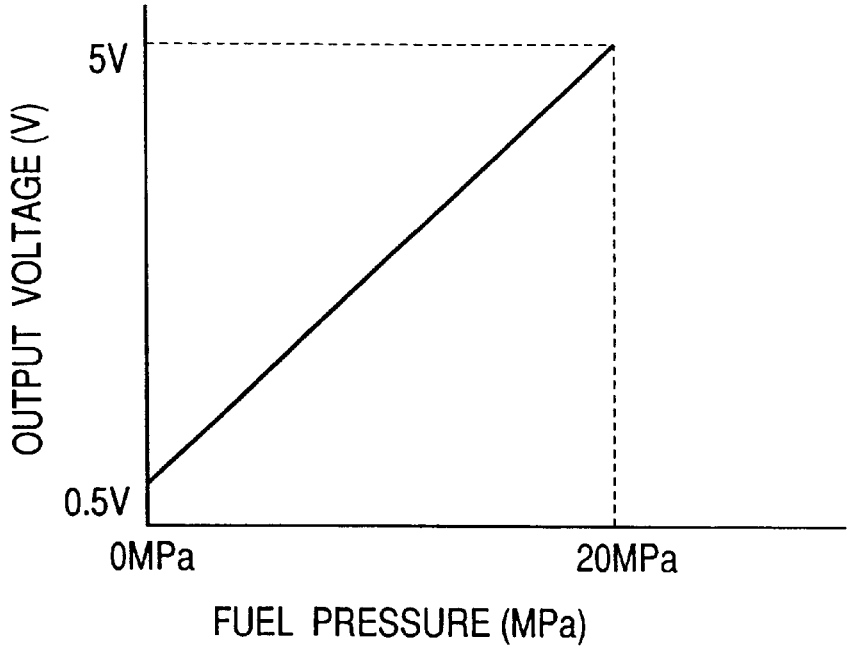
FIG. 8 shows an example of operation characteristics of the fuel pressure sensor as shown in FIG. 2.

FIG. 8 shows a characteristic of the fuel pressure sensor 14 as shown in FIGS. 1 and 2, which is designed to output electrical signals proportional to fuel pressures applied thereto. These fuel pressure signals are inputted to the control unit 17 as shown in FIG. 9.

The control unit 15 performs with a variety of programmed softwares in a microcomputer calculations based on input signals representing engine operating conditions including the output from the fuel pressure sensor 14, and controls the entire engine control system including the fuel supply control system.

Figure 9:
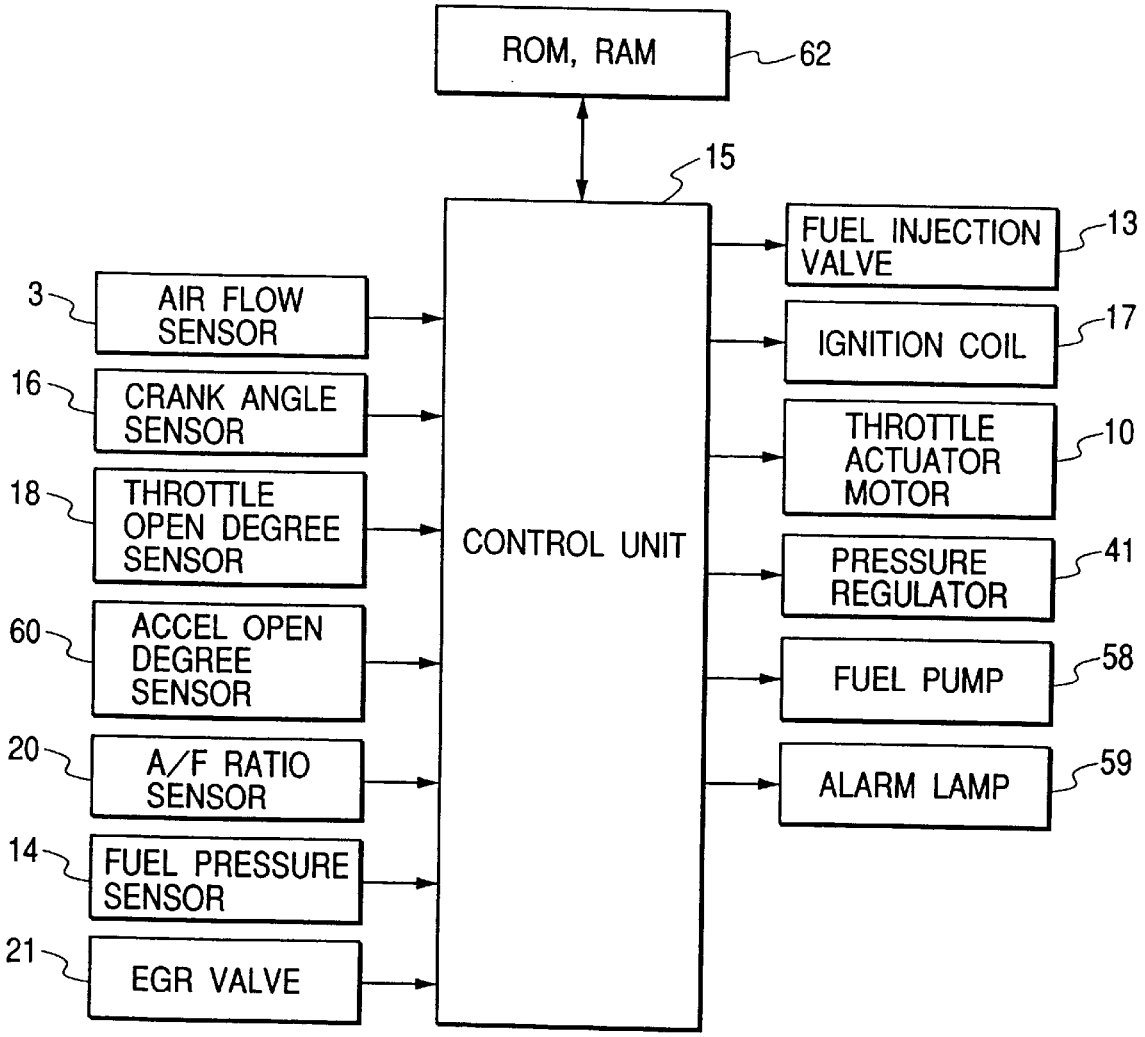
FIG. 9 is a diagram for explaining inputs and outputs of the control unit as shown in FIG. 1.

FIG. 9 shows inputs and outputs of the control unit 15. The inputs includes signals representing engine operating conditions such as an air flow rate, an engine rpm, an acceleration pedal opening degree corresponding to a command signal from a driver, a throttle opening degree corresponding to the acceleration pedal opening degree and a fuel pressure detected by the fuel pressure sensor 14. On the other hand, the outputs includes such as a command signal to the fuel injection valves 13 determining fuel amount and fuel injection timing, an ignition signal for firing the injected fuel, a throttle opening command signal corresponding to the acceleration pedal opening degree and a command signal to the electrically controlled pressure regulator 41 controlling the fuel pressure.

Figure 10:
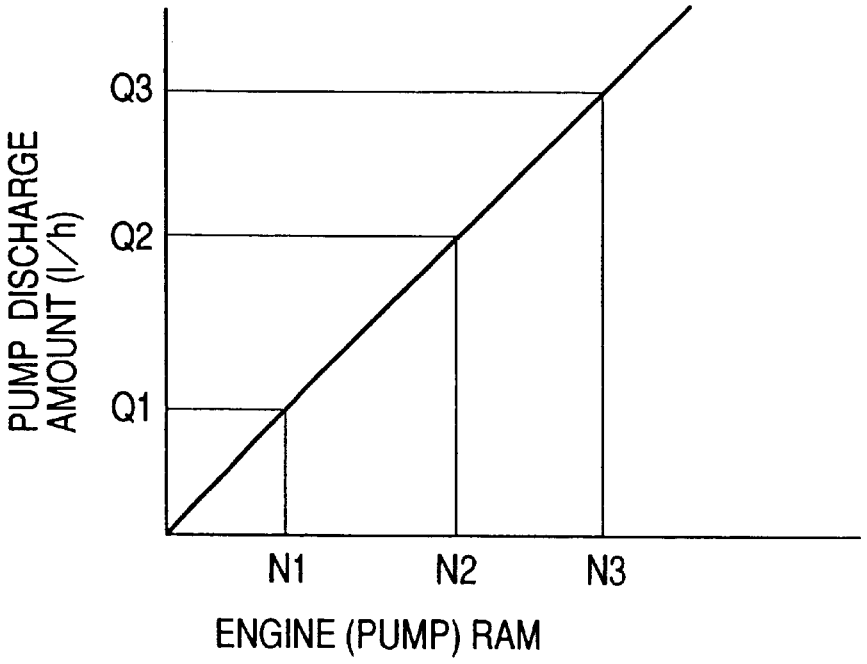
FIG. 10 is an exemplary diagram showing a relation between engine (pump) rpm and discharge amount of a fuel pump used in the fuel supply system as shown in FIG. 2.

Now, a control of the fuel pressure is explained. Since the fuel pump 42 is driven by an engine through direct coupling therewith, a relation between pump rpm proportional to engine rpm and fuel discharge amount as shown in FIG. 10 is observed. As seen from FIG. 10, since a discharged fuel amount from the fuel pump 42 is proportional to the engine rpm, if an engine rpm is specified, a single discharged fuel amount Q is determined.

Figure 11:
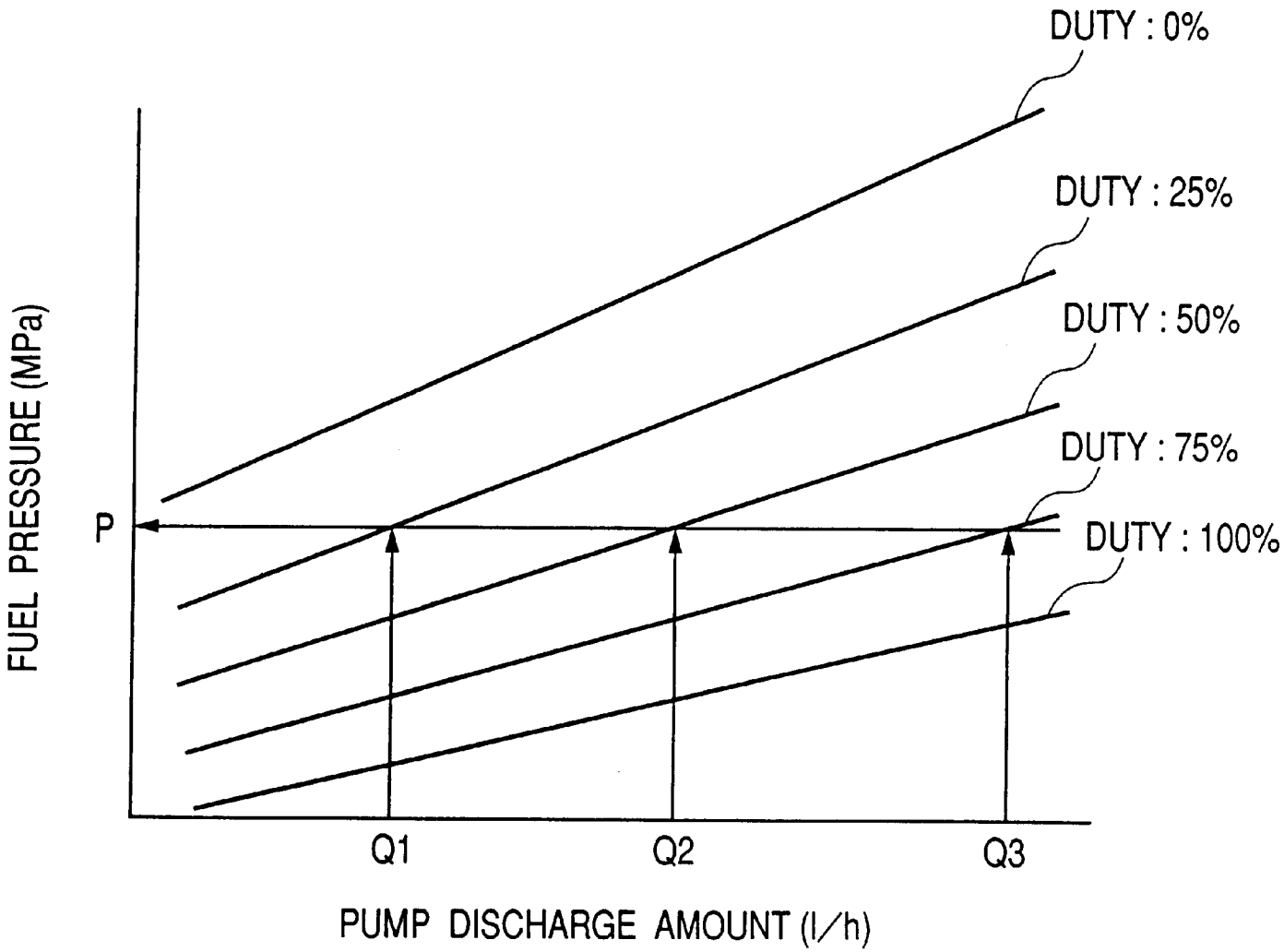
FIG. 11 is an exemplary diagram showing a relation between discharge amount of a fuel pump and control fuel pressure, when control duty for an electrically controlled pressure regulator is used as a parameter therefor in the fuel supply system as shown in FIG. 2.

FIG. 11 shows an operation characteristic of the electrically controlled pressure regulator 41. As seen from FIG. 11, a single fuel pressure is determined in relation to the control duty of the electrically controlled pressure regulator 41 and discharge amount of the fuel pump 42. For example, in order to set a fuel pressure at P (MPa) when the pump discharge amount is Q1 (l/h), it is required to select a control duty of 25% for the electrically controlled pressure regulator 41, on the other hand, when the pump discharge amount is Q3 (l/h), if a control duty of 75% for the electrically controlled pressure regulator 41 is selected, the fuel pressure of P (MPa) can be obtained.

However, in an actual control, the control is frequency performed under a condition that the engine rpm is constant.

Figure 12:
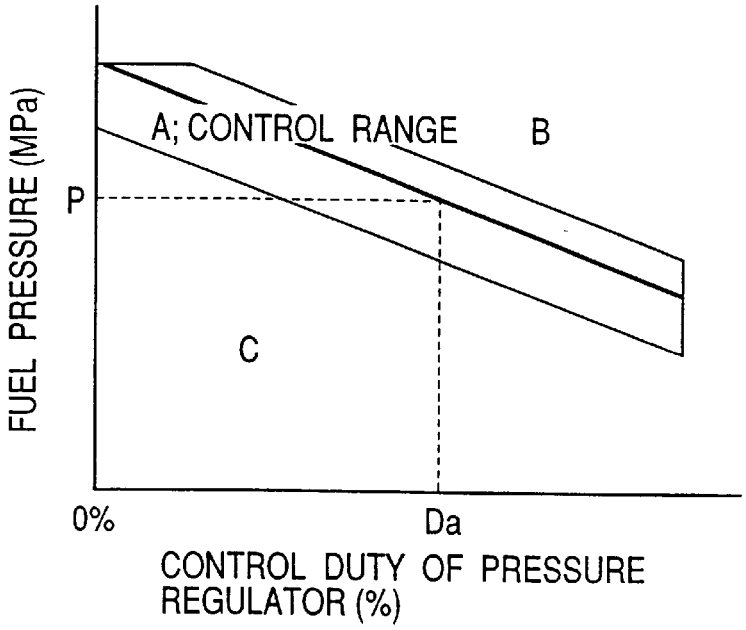
FIG. 12 is an exemplary diagram showing a relation between control duty of the electrically controlled pressure regulator and fuel pressure in the fuel supply system as shown in FIG. 2.

FIG. 12 shows a relation between control duty of the electrically controlled pressure regulator 41 and control fuel pressure, when the engine rpm is assumed constant, in other words the pump discharge fuel amount is constant, and it is assumed, for example, that the pump discharge fuel amount is constant at Q2 (l/H) as shown in FIG. 11. As seen from FIG. 12, when the control duty of the electrically controlled pressure regulator 41 is larger than Da, the escaping fuel flow rate from the electrically controlled pressure regulator 41 increases and the fuel pressure is lowered. On the other hand, when the control duty of the electrically controlled pressure regulator 41 is smaller than Da, the escaping fuel flow rate from the electrically controlled pressure regulator 41 decreases and the fuel pressure is elevated. Further, when the control duty of the electrically controlled pressure regulator 41 is 0%, namely, under the condition of no control amount, no fuel escapes from the electrically controlled pressure regulator 41 and the fuel pressure is extremely elevated. However, in such instance, the mechanical pressure regulator 61 regulates the fuel pressure below a predetermined upper limit.

Figure 13:
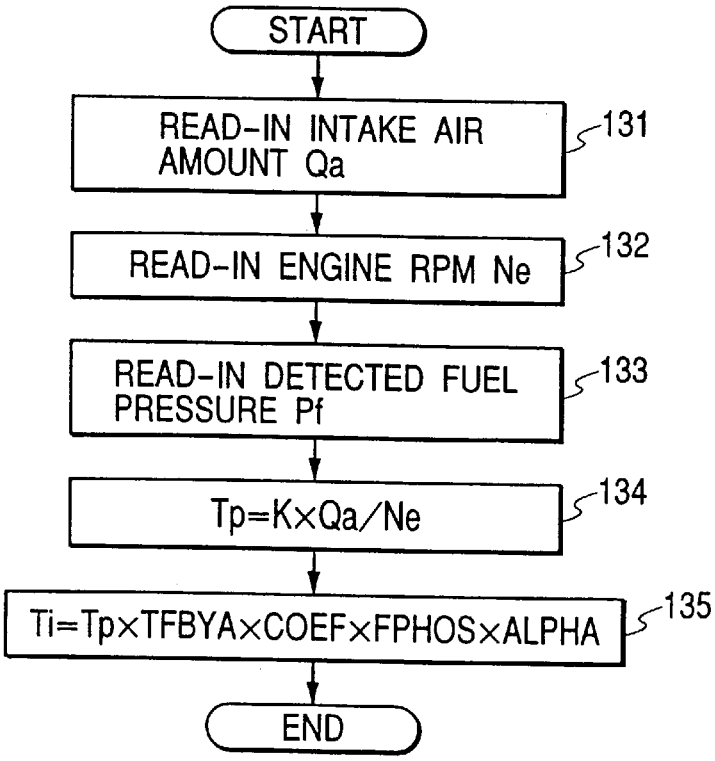
FIG. 13 is a flowchart showing control steps for calculating a fuel injection amount in the system shown in FIG. 1.

Now, calculation of a fuel injection pulse width for injecting an amount of fuel required by an engine in response to variation of fuel pressure is explained with a flowchart as shown in FIG. 13. The series of processings as shown in FIG. 13 is executed by an interruption in every predetermined period, for example, in every 10 ms. At step 131 an intake air amount Qa, at step 132 an engine rpm, and at step 133 a detected fuel pressure Pf corresponding to an output of the fuel pressure sensor 14 are read-in. At step 134 a primary fuel injection pulse width Tp is calculated according to the following mathematical formula (1);

$$Tp=K\times(Qa/Ne) \quad (1)$$

wherein K is an injection constant for a fuel injection valve which is determined so that a ratio of amount of air taken-in into a cylinder/amount of fuel injected thereinto assumes the stoichiometric air/fuel ratio of 14.7, when the fuel is injected at a fuel pressure of 10 MPa.

At step 135, a final fuel injection pulse width Ti is determined by multiplying a variety of correction coefficients to the previously calculated primary fuel injection pulse width Tp according to the following mathematical formula (2)

$$Ti=Tp\times TFBYA\times COEF\times FPHOS\times ALPHA \quad (2)$$

wherein TFBYA is a correction coefficient and is determined so that a ratio of amount of air taken-in into a cylinder/amount of fuel injected thereinto assumes a target air/fuel ratio. The target air/fuel ratio is determined, for example, with reference to a target air/fuel ratio map including x and y axes of primary fuel injection pulse width Tp and engine rpm Ne, COEF is a correction coefficient which is applied under a predetermined operating condition requiring such as transient correction and correction after starting, FPHOS is a fuel injection pulse width correction coefficient (fuel pressure correction coefficient) which is determined to eliminate fuel amount variation depending on fuel pressure variation which will be explained in detail with reference to FIGS. 14 and 15, and ALPHA is an air/fuel ratio feed back coefficient.

Figure 14:
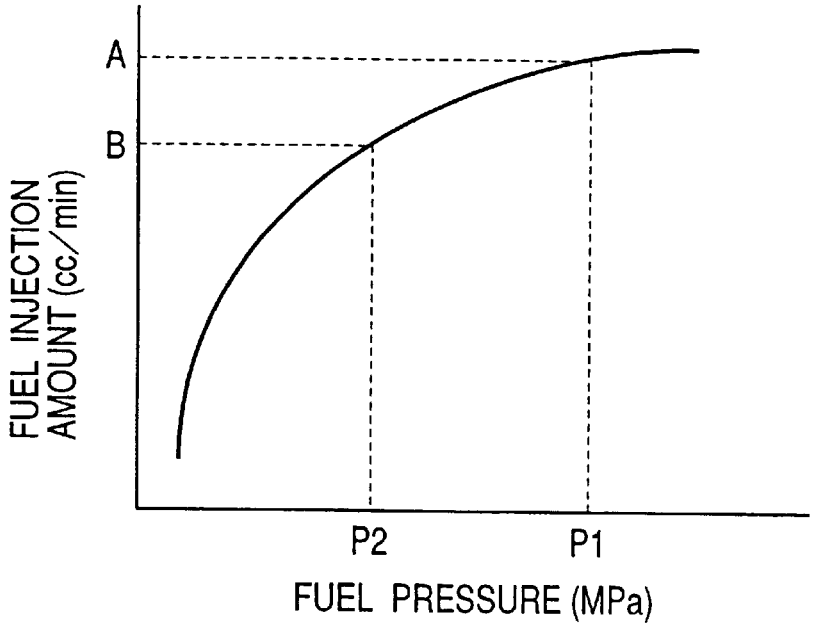
FIG. 14 is an exemplary diagram showing a relation between fuel pressure and fuel injection amount under a condition of a constant valve open pulse width for the fuel injection valve in the fuel supply system as shown in FIG. 2.

FIG. 14 shows a relation between fuel pressure and fuel injection amount under a condition that an open valve pulse width for the fuel injection valve 13 is kept constant. For example, when fuel pressure is P1, the fuel injection amount is A, and when fuel pressure is P2, the fuel injection amount is B.

Namely, FIG. 14 shows that even with a same fuel injection pulse width, the higher the fuel pressure is, the more the fuel injection amount is and the lower the fuel pressure is, the less the fuel injection amount.

A control of the fuel injection pulse width for injecting a predetermined amount of fuel regardless to variation of the fuel pressure is explained with reference to FIG. 15.

Figure 15:
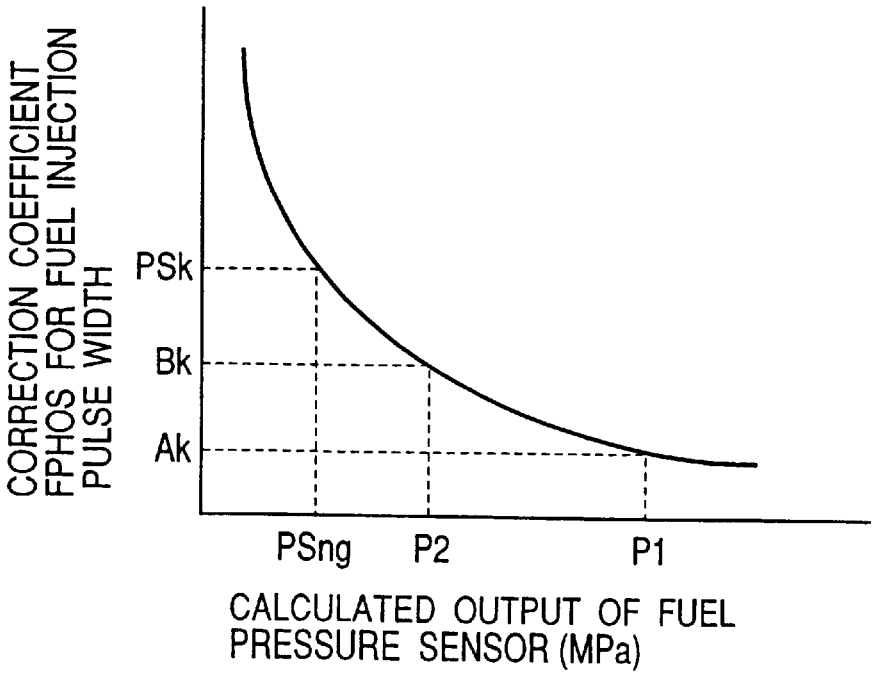
FIG. 15 is an exemplary diagram showing a relation between fuel pressure and fuel injection pulse width correction coefficient FPHOS in the system as shown in FIG. 1.

FIG. 15 shows a correction coefficient FPHOS of fuel injection pulse width with respect to fuel pressure.

When injecting a predetermined amount of fuel corresponding to an intake air amount from a fuel injection valve under a varying condition of fuel pressure, an excess or shortage of the fuel injection amount occurs under a same fuel injection pulse as shown in FIG. 14. Therefore, in order to obtain a same fuel injection amount regardless to variation of fuel pressure, the fuel injection pulse width correction coefficient FPHOS with respect to fuel pressure as shown in FIG. 15 is used. When the injection constant K of a fuel injection valve is set at the fuel pressure of 10 MPa, the fuel injection pulse width correction coefficient FPHOS is determined to be 1.0 when the detected fuel pressure Pf shows 10 MPa, and when the detected fuel pressure Pf lowers below 10 MPa, the fuel injection amount decreases, therefore, the fuel injection pulse width correction coefficient FPHOS is determined to be more than 1.0 so as to increase the fuel injection amount, on the other hand, when the detected fuel pressure Pf rises beyond 10 MPa, the fuel injection amount increases, therefore, the fuel injection pulse width correction coefficient FPHOS is determined to be less than 1.0 so as to decrease the fuel injection amount. For example, when a predetermined fuel injection amount Qinj is required, and when the detected fuel pressure at the moment is P1, the fuel injection pulse width correction coefficient FPHOS uses a coefficient Ak, and when the detected fuel pressure at another moment is P2, the fuel injection pulse width correction coefficient FPHOS uses a coefficient Bk, thereby, the same fuel amount Qinj is injected even under a varying condition of fuel pressure.

In the above, a control arrangement for an internal combustion engine including control arrangement for fuel supply system to which the present invention is applied is explained.

Now, a behavior of the fuel supply system is explained, when either the electrically controlled pressure regulator 41 or the fuel pressure sensor 14 therein is failed.

The control range A in FIG. 12 represents where the fuel supply system is operating in normal. On the other hand, the ranges B and C represent where the fuel supply system is not operating in normal. For example, the range B represents where the detected fuel pressure shows rather higher than the expected fuel pressure with respect to a concerned control duty of the electrically controlled pressure regulator 41. Such phenomenon can happen either when the electrically controlled pressure regulator 41 becomes abnormal or the fuel pressure sensor 14 becomes abnormal. When the electrically controlled pressure regulator 41 is abnormal, the cause thereof will be that the valve of the electrically controlled pressure regulator 41 can not be driven up to a predetermined opening degree in response to the concerned control duty. Further, when the fuel pressure sensor 14 is abnormal, the cause thereof will be that the fuel pressure detected by the fuel pressure sensor 14 shows rather higher than the actual fuel pressure prevailing in the fuel supply system.

The range C represents where the detected fuel pressure shows rather lower than the expected fuel pressure with respect to a concerned control duty of the electrically controlled pressure regulator 41. Such phenomenon can happen either when the electrically controlled pressure regulator 41 becomes abnormal or the fuel pressure sensor 14 becomes abnormal. When the electrically controlled pressure regulator 41 is abnormal, the cause thereof will be that the valve of the electrically controlled pressure regulator 41 is driven beyond a predetermined opening degree in response to the concerned control duty. Further, when the fuel pressure sensor 14 is abnormal, the cause thereof will be that the fuel pressure detected by the fuel pressure sensor 14 shows rather lower than the actual fuel pressure prevailing in the fuel supply system.

Namely, when either the electrically controlled pressure regulator 41 or the fuel pressure sensor 14 becomes abnormal, the fuel pressure detected by the fuel pressure sensor 14 shows one outside a predetermined control range A determined by a concerned control duty for the electrically controlled pressure regulator 41.

When either the electrically controlled pressure regulator 41 or the fuel pressure sensor 14 becomes abnormal, a required fuel amount and fuel pressure for performing combustion in an engine can not be obtained. Hereinbelow, a method of detecting whether the electrically controlled pressure regulator 41 or the fuel pressure sensor 14 becomes abnormal is explained with reference to the following flowcharts.

Figure 16:
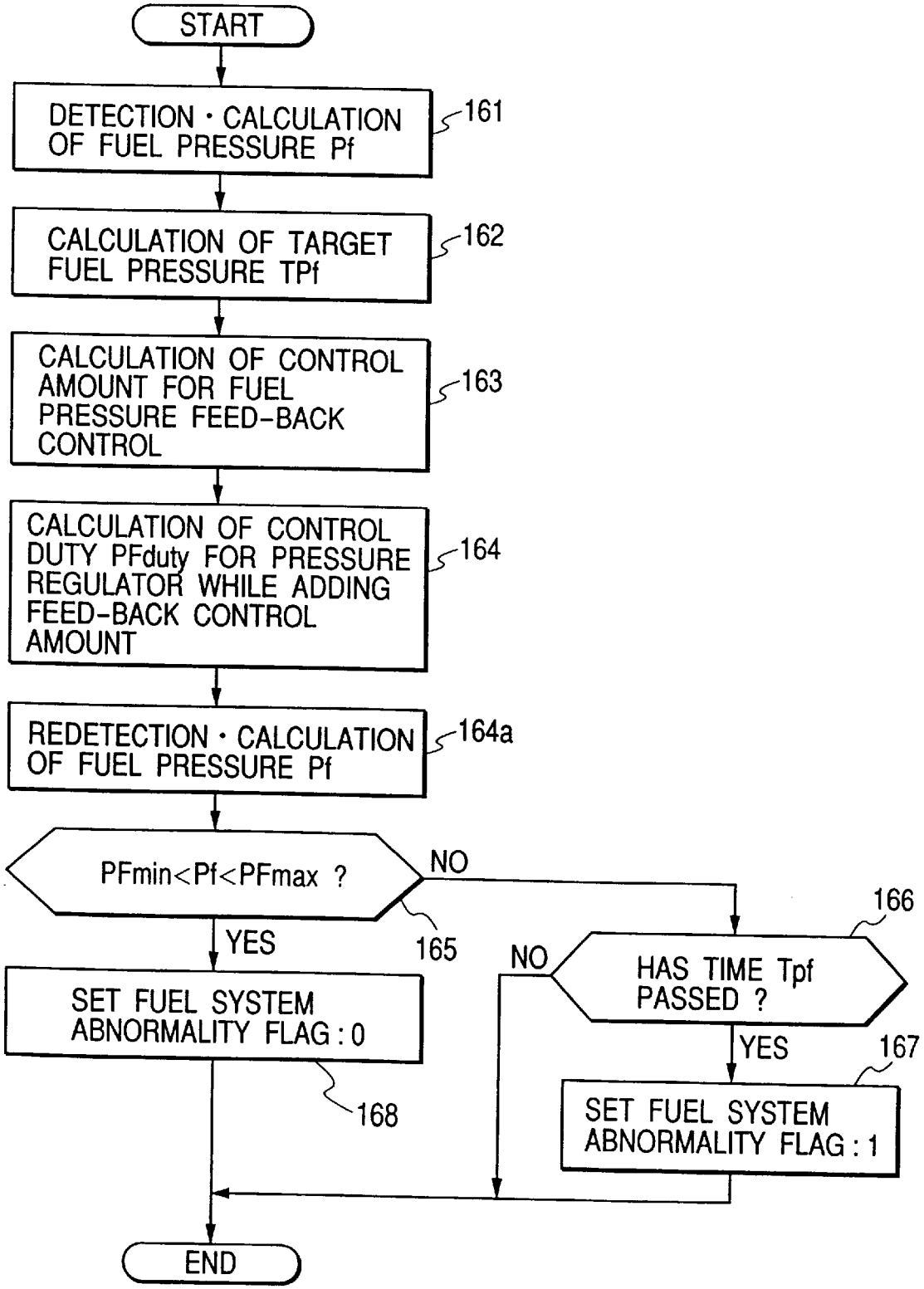
FIG. 16 is a flowchart showing control steps for detecting an abnormality in the fuel supply system as shown in FIG. 2 according to the present invention.

FIG. 16 is a control flowchart for detecting abnormality in the fuel supply system as has been explained in connection with FIG. 12. At step 161, a fuel pressure Pf is calculated based on the output voltage $V_{fuel}$ of the fuel pressure sensor 14 while making use of the relation between output voltage and fuel pressure of the fuel pressure sensor 14 as shown in FIG. 8. At step 162 a control fuel pressure map, which is determined depending on engine operating conditions, in other words engine operating modes, is retrieved based on signals representing engine operating conditions such as engine rpm and engine load, and a target fuel pressure TPf is calculated. At step 163, a deviation, in other words a feed back control amount between the detected fuel pressure Pf by the fuel pressure sensor 14 at step 161 and the calculated target fuel pressure TPf, is calculated in order to perform a fuel pressure feed back control so as to coincide the detected fuel pressure Pf with the target fuel pressure TPf. At step 164, a control duty map of the electrically controlled pressure regulator 41 which is determined depending on engine operating conditions, is retrieved based on signals representing engine operating conditions such as engine rpm and engine load, and a control duty $PF_{duty}$ of the electrically controlled pressure regulator 41 is calculated while adding the fuel pressure feed back control amount calculated at step 163. At step 164*a*, a fuel pressure Pf corresponding to the calculated control duty of $PF_{duty}$ is again detected and calculated. At step 165, it is judged whether the newly calculated fuel pressure Pf at step 164*a* is above a upper limit fuel pressure $PF_{max}$ or below a lower limit fuel pressure $PF_{min}$ which are determined based on the control duty $PF_{duty}$ of the electrically controlled pressure regulator 41 calculated at step 164 and which serve for judging abnormality in the fuel supply system. At step 165, if the fuel pressure Pf calculated according to the output value from the fuel pressure sensor 14 is within the upper and lower limits, it is judged at step 168 that no abnormality exists in the fuel supply system and a fuel supply system abnormality flag is set at 0. On the other hand, if the fuel pressure Pf is outside the upper and lower limits, at step 166 it is judged whether the above condition continues more than a predetermined period of Tpf, if no, the control process goes to end, contrary if yes, it is judged at step 167 that an abnormality exists in the fuel supply system and a fuel supply system abnormality flag is set at 1.

Figure 17:
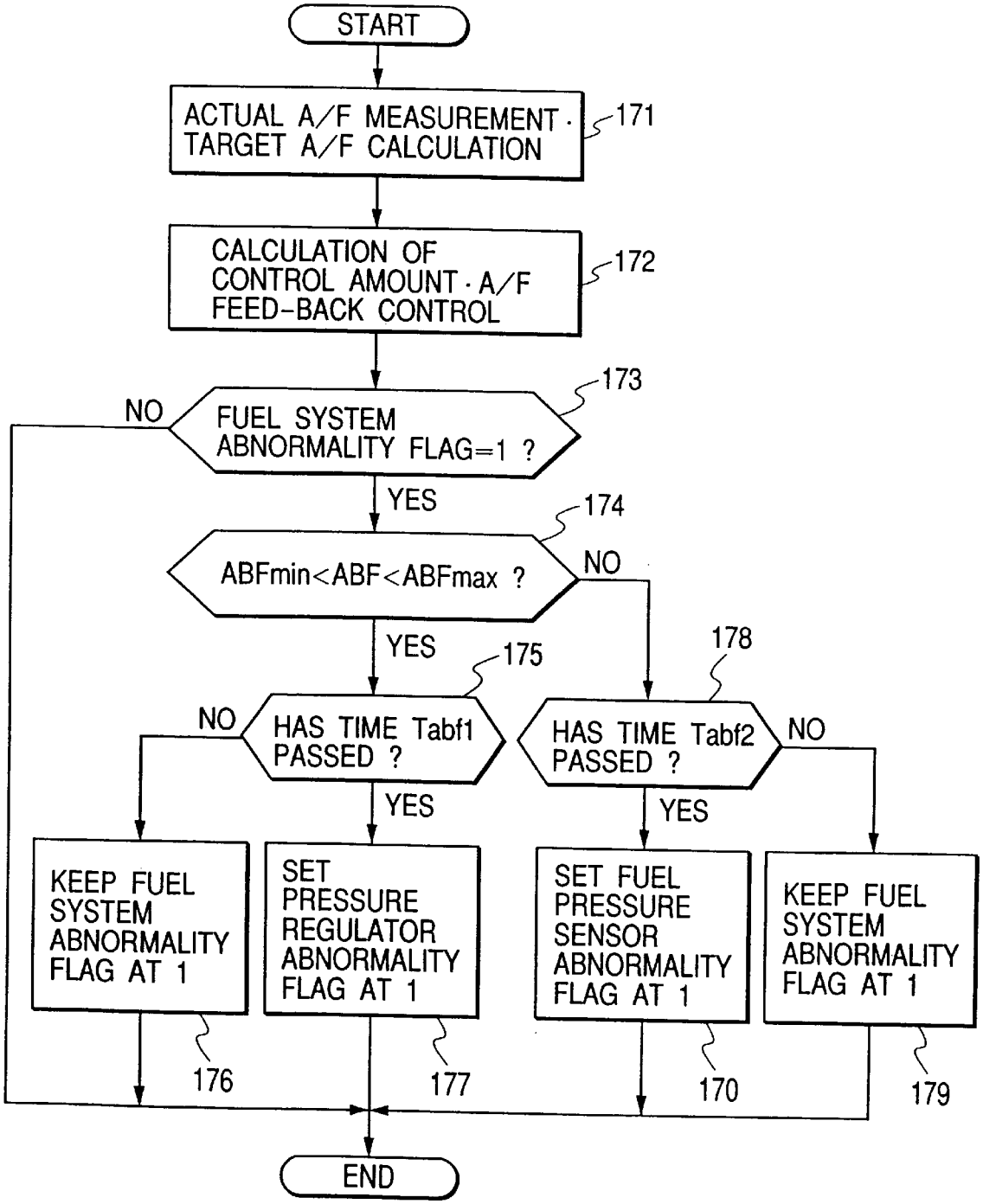
FIG. 17 is a flowchart showing control steps for specifying a possible failure element by making use of an air/fuel ratio according to the present invention.

FIG. 17 is a control flowchart for specifying a possible abnormal element in the fuel supply system, when an abnormality in the fuel supply system is detected in the processes as explained in connection with FIG. 16.

In order to specify a possible abnormal element in the fuel supply system, signals representing air/fuel ratio status including air/fuel ratio signals and air/fuel ratio feed back control amount which are inputted into the control unit 15 are used.

Now, a method of specifying a possible abnormal element by making use of signals from an air/fuel sensor is explained with reference to FIG. 17. At step 171, an actual air/fuel ratio ABF is measured from an exhaust gas of the engine, and further a target air/fuel ratio which is determined depending on engine operating conditions is calculated based on signals representing engine operating conditions such as engine rpm and engine load.

At step 172, a deviation between the measured air/fuel ratio ABF and the calculated air/fuel ratio at step 171 is calculated in order to perform an air/fuel ratio feed back control so as to coincide the measured air/fuel ratio ABF with the calculated target air/fuel ratio. At step 173, it is judged whether the fuel supply system abnormality flag is set at 1 as has been explained in connection with FIG. 16. If no fuel supply system abnormality flag is set at 1, the process goes to end. On the other hand, if the answer is yes, at step 174, an actual air/fuel ratio ABF after performing the air/fuel ratio feed back control at step 172 is measured again, and it is judged whether the remeasured air/fuel ratio is within a predetermined air/fuel ratio range which is acceptable for realizing combustion in the engine. Namely, at step 174, it is judged whether the remeasured air/fuel ratio is within a predetermined air/fuel ratio range of an upper limit $ABF_{max}$ and a lower limit $ABF_{min}$ which are acceptable for realizing combustion in the engine, and if the answer is yes, it is judged at step 175 whether the above condition continues more than a predetermined time period $T_{abf}1$, if no, the fuel supply system abnormality flag is kept set at 1 at step 176. If the answer is yes, at step 177 an electrically controlled pressure regulator abnormality flag is set at 1.

On the other hand, if the actual air/fuel ratio ABF is outside the predetermined air/fuel ratio of the upper limit $ABF_{max}$ and the lower limit $ABF_{min}$ acceptable for realizing combustion in the engine at step 174, it is judged at step 178 whether the above condition continues more than a predetermined time period $T_{abf}2$, and if the answer is no, the fuel supply system abnormality flag is kept set at 1 at step 179. Contrary, if the answer at step 178 is yes, a fuel pressure sensor abnormality flag is set at 1 at step 170. An abnormality judgement in the fuel pressure sensor will be explained in detail with reference to FIG. 19.

Figure 18:
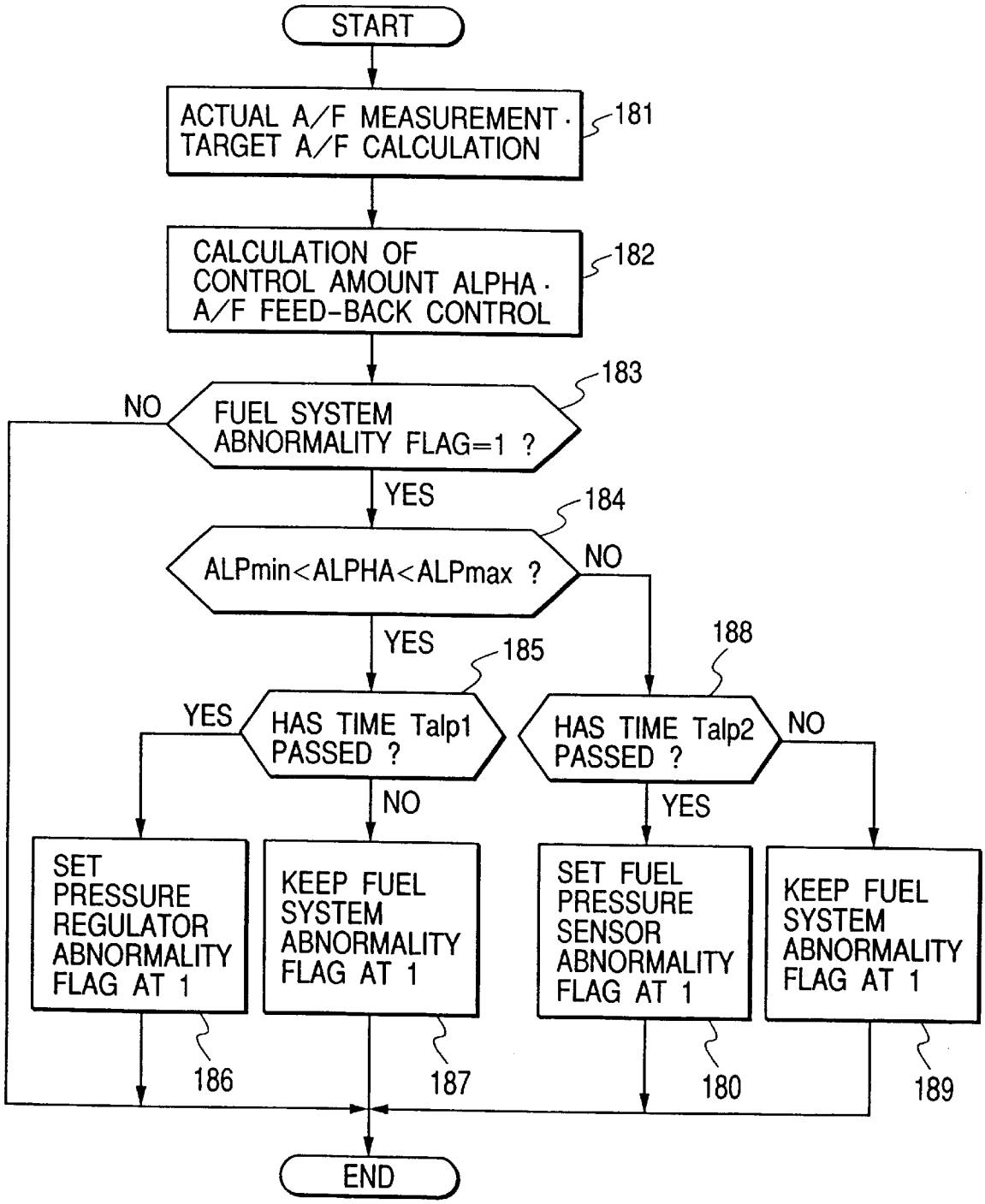
FIG. 18 is a flowchart showing control steps for specifying a possible failure element by making use of an air/fuel ratio feed back control amount according to the present invention.

Now, another method of specifying a possible abnormal element by making use of air/fuel ratio feed back control amounts, in other words signals from an $O_2$ sensor is explained with reference to FIG. 18.

At step 181 an actual air/fuel ratio ABF is measured from an exhaust gas of the engine and further, a target air/fuel ratio which is determined depending on engine operating conditions is calculated based on signals representing engine operating conditions such as engine rpm and engine load.

At step 182, a deviation between the measured air/fuel ratio ABF and the calculated air/fuel ratio at step 181 is calculated to determine an air fuel ratio feed back control amount ALPHA, and an air/fuel ratio feed back control is performed based on the determined air/fuel ratio feed back control amount ALPHA so as to coincide the measured air/fuel ratio ABF with the calculated target air/fuel ratio.

At step 183, it is judged whether the fuel supply system abnormality flag is set at 1 as has been explained in connection with FIG. 16. If no fuel supply system abnormality flag is set at 1, the process goes to end. On the other hand, if the answer is yes, at step 184 it is judged whether the air/fuel ratio feed back control amount determined at step 182 is within a predetermined range which is acceptable for realizing combustion in the engine. Namely, at step 184, it is judged whether the air/fuel ratio feed back control amount ALPHA is within the predetermined range of an upper limit $ALP_{max}$ and a lower limit $ALP_{min}$ which are acceptable for realizing combustion in the engine, and if the answer is yes, it is judged at step 185 whether the above condition continues more than a predetermined time period $T_{alp}1$, if no, the fuel supply system abnormality flag is kept set at 1 at step 187. If the answer is yes, at step 186 an electrically controlled pressure regulator abnormality flag is set at 1.

On the other hand, if the air/fuel ratio feed back control amount ALPHA is outside the predetermined range acceptable for realizing combustion in the engine, in that, equal to the upper limit $ALP_{max}$ or the lower limit $ALP_{min}$ at step 184, it is judged at step 188 whether the above condition continues more than a predetermined time period $T_{alp}2$, and if the answer is no, the fuel supply system abnormality flag is kept set at 1 at step 189. Contrary, if the answer at step 188 is yes, a fuel pressure sensor abnormality flag is set at 1 at step 180. An abnormality judgement in the fuel pressure sensor will be explained in detail with reference to FIGS. 19 and 20.

Figure 19:
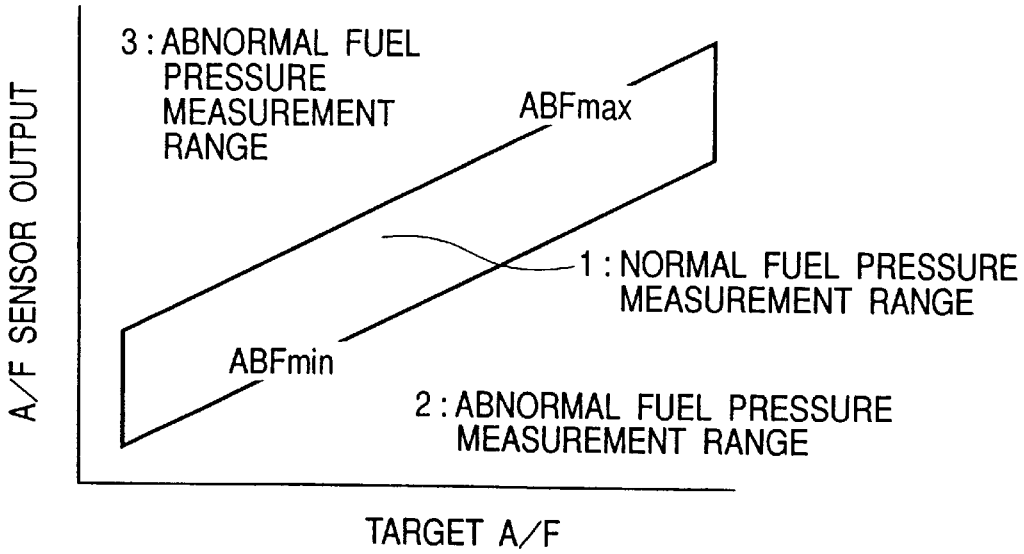
FIG. 19 shows an example of operation characteristics of an A/F ratio sensor used in the system shown in FIG. 1.

With reference to FIG. 19, how an abnormal element is specified based on the outputs from an air/fuel ratio sensor is explained.

An engine is operated at a predetermined air/fuel ratio by injecting a predetermined amount of fuel through fuel injection valves into the engine in response to an intake air amount. As explained in connection with FIG. 14, the amount of fuel injected varies depending on the fuel pressure, therefore, if an abnormality exists in the fuel pressure sensor, a detected fuel pressure deviates from an control fuel pressure. As a result, if the fuel injection is performed based on the detected fuel pressure, an actual air/fuel ratio greatly deviates from the predetermined set air/fuel ratio. Namely, when the fuel pressure sensor becomes abnormal, the fuel pressure sensor, for example, detects fuel pressure PSng at the time when the actual fuel pressure is P2 as shown in FIG. 15, and an erroneous fuel injection pulse width correction coefficient PSk is determined based on the erroneous fuel pressure PSng, therefore, a fuel injection is performed with an erroneous fuel injection pulse width other than one actually required. As a result, the actual air/fuel ratio deviates from the target air/fuel ratio, which condition corresponds to ABNORMAL FUEL PRESSURE MEASUREMENT RANGE 2 and 3 as illustrated in FIG. 19. Further, because of the deviation of the actual air/fuel ratio from the target air/fuel ratio, an extremely large air/fuel ratio feed back control amount is required, and resultantly the air/fuel ratio feed back control amount finally reaches either the upper limit $ALP_{max}$ or the lower limit $ALP_{min}$.

On the other hand, when the electrically controlled pressure regulator becomes abnormal, in that when the fuel pressure can not be controlled depending on a predetermined control duty thereof, in other words when the fuel pressure goes outside the upper and lower limits determined by the predetermined control duty thereof, the fuel injection is performed depending on an actual fuel pressure determined by a normal fuel pressure sensor, therefore, the actual air/fuel ratio never deviates greatly from the target air/fuel ratio, which corresponds to NORMAL FUEL PRESSURE MEASUREMENT RANGE 1 as illustrated in FIG. 19. Further, with no deviation of the actual air/fuel ratio from the target air/fuel ratio, the air/fuel ratio feed back control amount remains within a predetermined control amount below the upper limit $ALP_{max}$ and beyond the lower limit $ALP_{min}$.

While making use of the above explained characteristics, it is judged whether the actual air/fuel ratio is within the predetermined air/fuel ratio which is acceptable for realizing combustion in the engine, and when the above actual air/fuel ratio is within the predetermined air/fuel range or the air/fuel feed back control amount ALPHA is within a predetermined control amount of the upper and lower limits, it is judged that there exists an abnormality in the electrically controlled pressure regulator. On the other hand, when the actual air/fuel ratio ABF is outside the predetermined air/fuel ratio acceptable for realizing combustion in the engine or when the air/fuel ratio feed back control amount ALPHA is equal to the upper or lower limit of the air/fuel ratio feed back control amount, it is judged that there exists an abnormality in the fuel pressure sensor.

Figure 20:
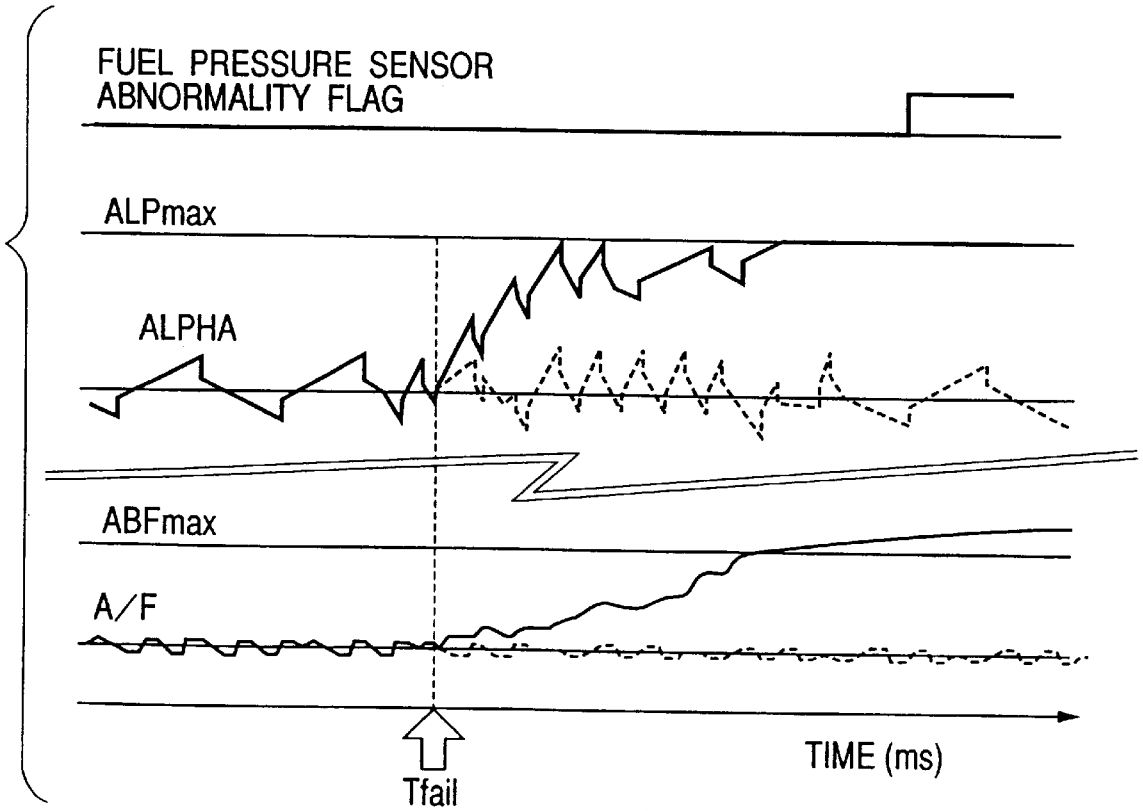
FIG. 20 is a diagram for explaining how abnormality in a fuel pressure sensor is decided, when the operation characteristics of an A/F ratio sensor is used according to the present invention.

FIG. 20 shows variations of air/fuel ratio A/F and air/fuel ratio feed back control amount ALPHA after the fuel pressure sensor becomes abnormal.

When the fuel pressure sensor becomes abnormal at a moment $T_{fail}$ as shown in FIG. 20, the fuel pressure correction in the fuel injection control is performed based on the fuel pressure detected by the abnormal fuel pressure sensor, and resultantly the actual air/fuel ratio goes away from the target air/fuel ratio. In response to such deviation, the air/fuel ratio feed back control functions to move the actual air/fuel ratio toward the target air/fuel ratio. However, since the output of the fuel pressure sensor is abnormal, the actual air/fuel ratio can not be corrected with the air/fuel ratio feed back control amount ALPHA and resultantly, the air/fuel ratio feed back amount ALPHA finally sticks either to the upper limit $ALP_{max}$ or to the lower limit $ALP_{min}$. Namely, it becomes impossible to eliminate the deviation from the target air/fuel ratio with the air/fuel ratio feed back control, and the actual air/fuel ratio goes out of the predetermined air/fuel ratio range with respect to the target air/fuel ratio, thus an abnormality in the fuel pressure sensor is judged.

Figure 21:
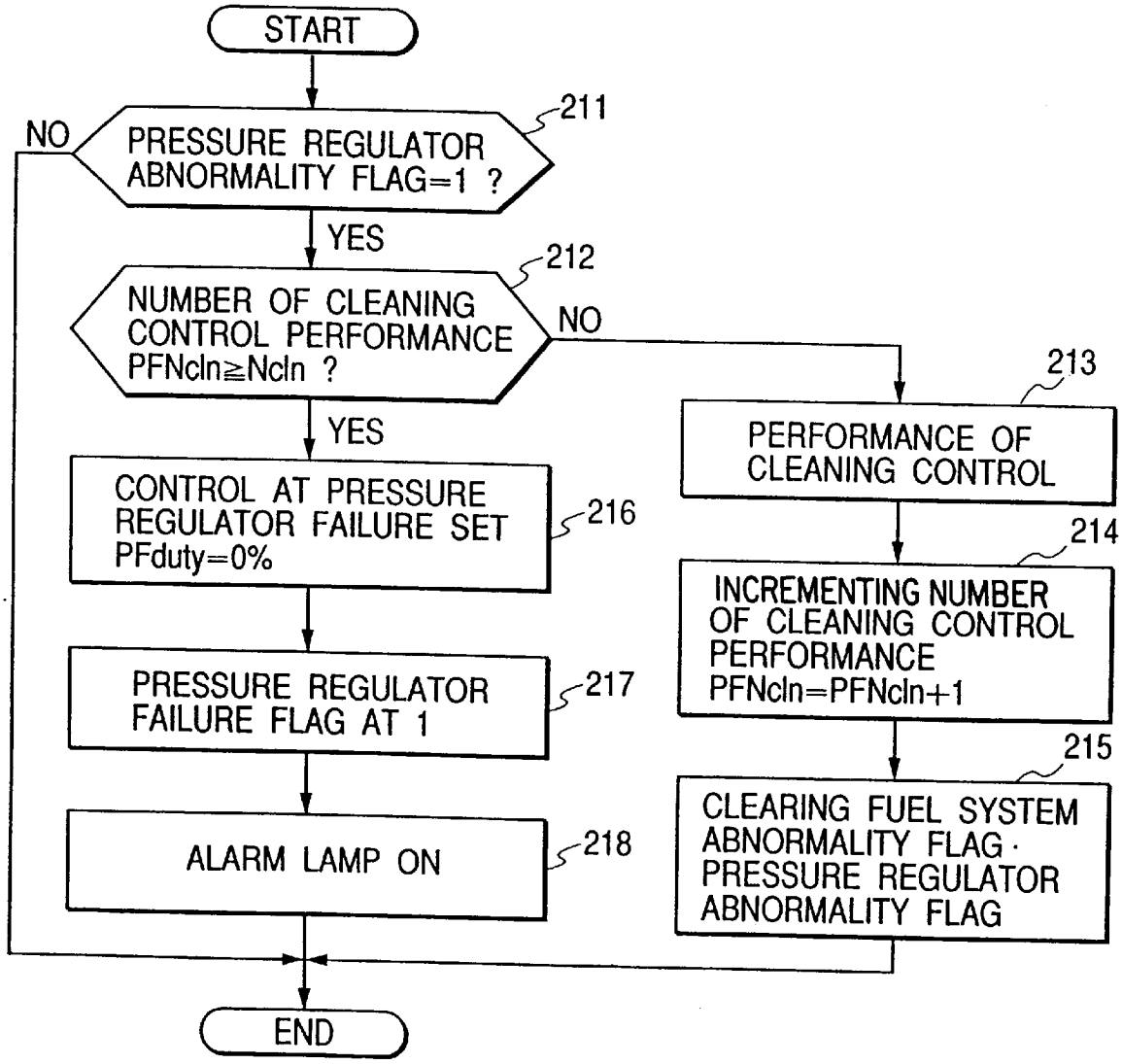
FIG. 21 is a flowchart showing control steps for performing a cleaning control for an electrically controlled pressure regulator and for detecting abnormality therein according to the present invention.

FIG. 21 is a control flowchart after an abnormality in the electrically controlled pressure regulator is detected in the processings as has been explained is connection with FIG. 17. At step 211, it is checked whether the electrically controlled pressure regulator abnormality flag is set at 1. If the answer is no, the process goes to end. On the other hand, if the answer is yes, the process goes to step 212.

Figure 22:
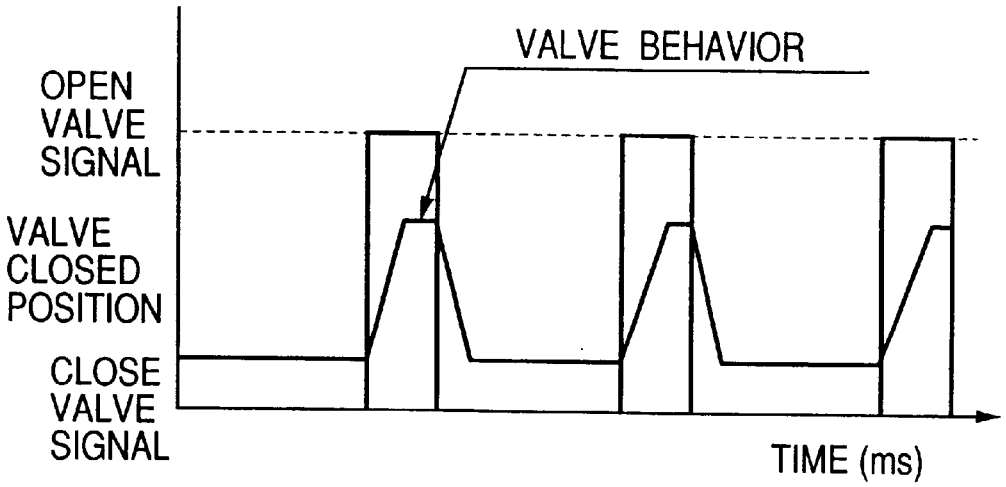
FIG. 22 is a diagram for explaining a cleaning control for an electrically controlled pressure regulator according to the present invention.

At step 212, it is judged whether the number of execution $PFN_{cln}$ of cleaning mode of the electrically controlled pressure regulator exceeds a predetermined number $N_{cln}$, for example 5 times, and if the answer is no, the cleaning mode of the electrically controlled pressure regulator, which will be explained later in detail with reference to FIG. 22, is executed at step 213. After executing the cleaning mode of the electrically controlled pressure regulator at step 213, the execution number $PFN_{cln}$ of the cleaning mode of the electrically controlled pressure regulator is incremented by 1 at step 214. At step 215, both the fuel supply system abnormality flag and the electrically controlled pressure regulator abnormality flag are cleared to 0 and the process moves to a normal operation.

On the other hand, when it is found out at step 212 that the number of execution $PFN_{cln}$ of the cleaning mode of the electrically controlled pressure regulator already exceeds the predetermined number $N_{cln}$, it is presumed that the abnormality is not because of a deposit of a foreign matter at the valve seat portion of the electrically controlled pressure regulator, but because of an actual failure of the electrically controlled pressure regulator itself occurs such as disconnection of the coil therein, therefore, at step 216 a failure of the electrically controlled pressure regulator is determined, the fuel pressure feed back control which makes use of the electrically controlled pressure regulator is terminated and the control duty $PF_{duty}$ of the electrically controlled pressure regulator is fixed at a constant value, for example, 0% so as to maintain an operable condition for the engine. At step 217 an electrically controlled pressure regulator failure flag is set at 1, and at step 218 an alarm lamp is turned on to inform the failure to the driver.

The execution of the cleaning mode of the electrically controlled pressure regulator is explained with reference to FIG. 22.

During the cleaning mode the electrically controlled pressure regulator is operated while alternating large and small two control duties which are different from the immediately prior prevailing control duty. Through repeating the alternating use of the large and small control duties in comparison with one used in the immediately prior normal operating condition, the plunger of the electrically controlled pressure regulator is displaced largely thereby the flow rate and the flow velocity of the fuel passing through the electrically controlled pressure regulator vary greatly to clean the valve and valve seat portion of the electrically controlled pressure regulator. As a result, foreign matters deposited at the seat portion and the plunger portion of the electrically controlled pressure regulator are removed, and the uncontrol-ability of the fuel pressure due to abnormality at the seat portion of the electrically controlled pressure regulator is resolved.

Figure 23:
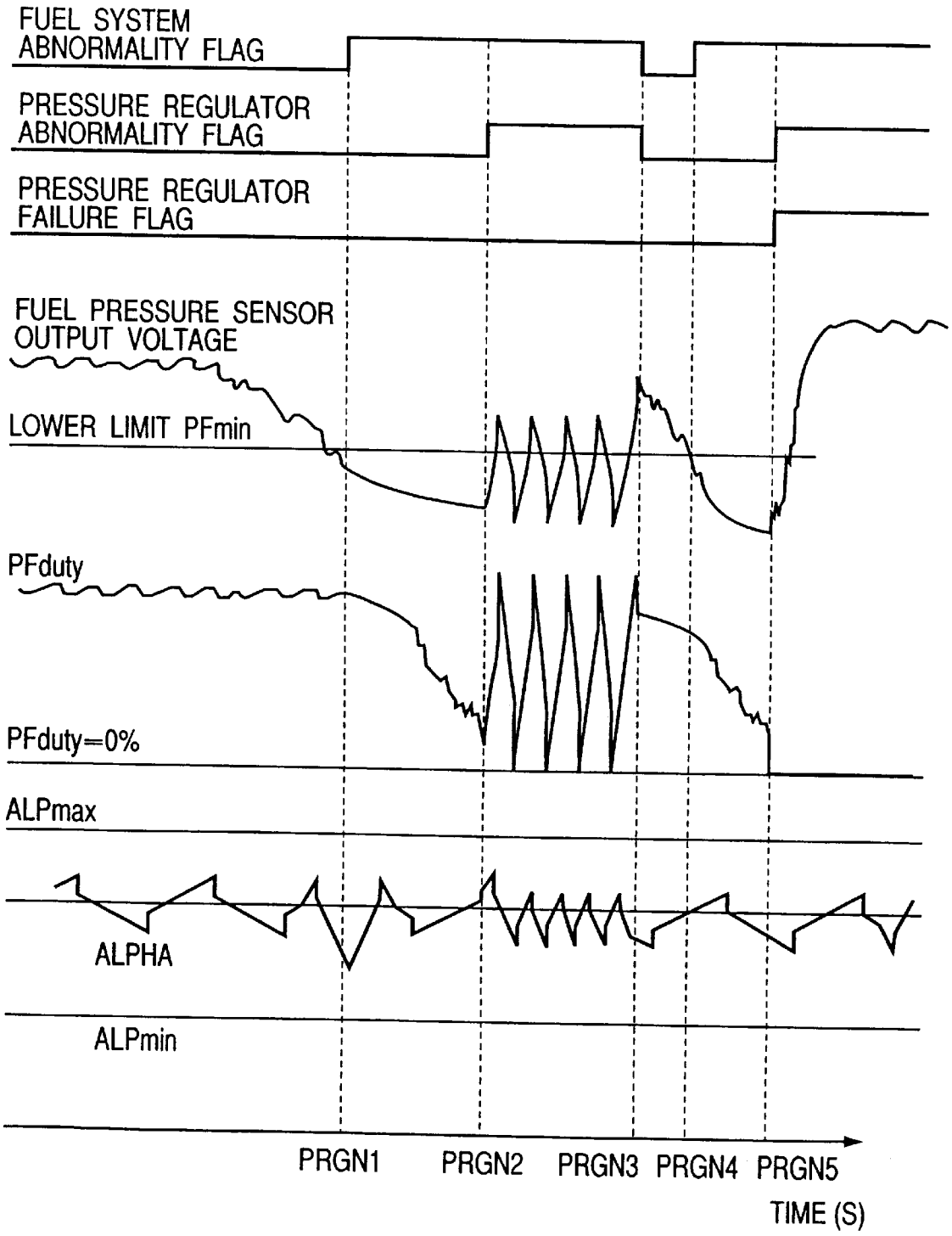
FIG. 23 is a diagram for explaining a cleaning control of an electrically controlled pressure regulator and an abnormality decision therein by making use of output characteristics of a fuel pressure sensor according to the present invention.

FIG. 23 shows variations of output voltage of the fuel pressure sensor, the control duty of the electrically controlled pressure regulator and the air/fuel feed back control amount ALPHA, when the electrically controlled pressure regulator becomes abnormal.

For example, when the driving coil of the electrically controlled pressure regulator becomes abnormal, the fuel pressure in the fuel supply system can not be controlled and, for example, the fuel pressure reduces abnormally with respect to the target fuel pressure, and in response to the abnormal fuel pressure reduction the fuel pressure feed back control functions to vary the control duty of the electrically controlled pressure regulator so as to reduce the deviation of the detected fuel pressure from the target fuel pressure. However, at the time PRGN1 the fuel pressure Pf corresponding to the output voltage of the fuel pressure sensor decreases below the lower limit fuel pressure $PF_{min}$ which is determined based on a concerned control duty $PF_{duty}$ and which serves for judging abnormality in the fuel supply system as has been explained in connection with FIG. 16, and the fuel supply system abnormality flag is set at 1.

In response to setting of the fuel supply system abnormality flag at 1, a possible abnormal element is specified based on the air/fuel ratio status signals as has been explained in connection with FIG. 17 or FIG. 18, and at the moment PRGN2 in FIG. 23 the electrically controlled pressure regulator abnormality flag is set at 1.

In response to the setting of the electrically controlled pressure regulator abnormality flag at 1, the cleaning control of the electrically controlled pressure regulator as has been explained in connection with FIG. 21 is performed, and at the time PRGN3 in FIG. 23 the fuel supply system abnormality flag and the electrically controlled pressure regulator abnormality flag are once cleared to 0. In case when the fuel pressure control becomes uncontrollable because foreign matters such as dust deposit on the valve seat portion of the electrically controlled pressure regulator, the fuel pressure control will be restored through the cleaning control. However, in the present case the abnormality in the driving coil is assumed, the abnormality of the electrically controlled pressure regulator can not be resolved by the cleaning control, therefore, at the timing PRGN4 the fuel supply system abnormality flag is set at 1 and at the timing PRGN5 both the electrically controlled pressure regulator abnormality flag and failure flag are set at 1, and the fuel pressure feed back control which makes use of the electrically controlled pressure regulator is terminated and the control duty $PF_{duty}$ of the electrically controlled pressure regulator is fixed at a constant value, for example 0% so as to maintain an operable condition for the engine, and an alarm lamp is turned on to inform the failure to the driver.

Figure 24:
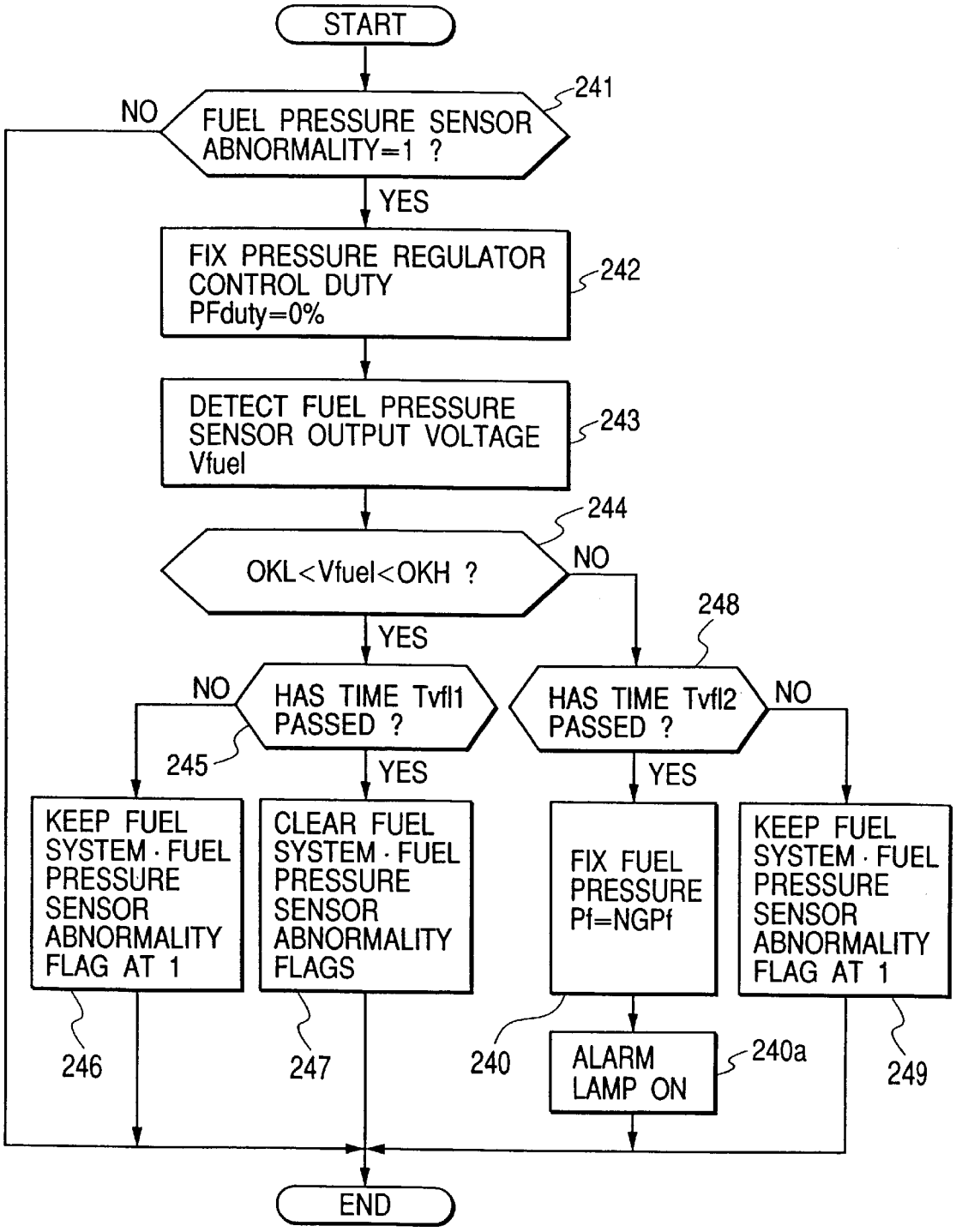
FIG. 24 is a flowchart showing control steps for detecting abnormality in a fuel pressure sensor by making use of the output voltage characteristics thereof according to the present invention.

FIG. 24 shows a control flowchart when an abnormality in the fuel pressure sensor is detected in the processing routine as has been explained in connection with FIG. 17. At step 241 it is checked whether the fuel pressure sensor abnormality flag is set at 1, and if the answer is no, the process goes to end. On the other hand, if the answer is yes, the control duty $PF_{duty}$ of the electrically controlled pressure regulator is fixed at a constant value other than a normal control, for example 0% or a full control amount of 100%. At step 243, the output voltage $V_{fuel}$ of the fuel pressure sensor is measured while fixing the control duty $PF_{duty}$ of the electrically controlled pressure regulator at 0% or 100%.

Figure 25:
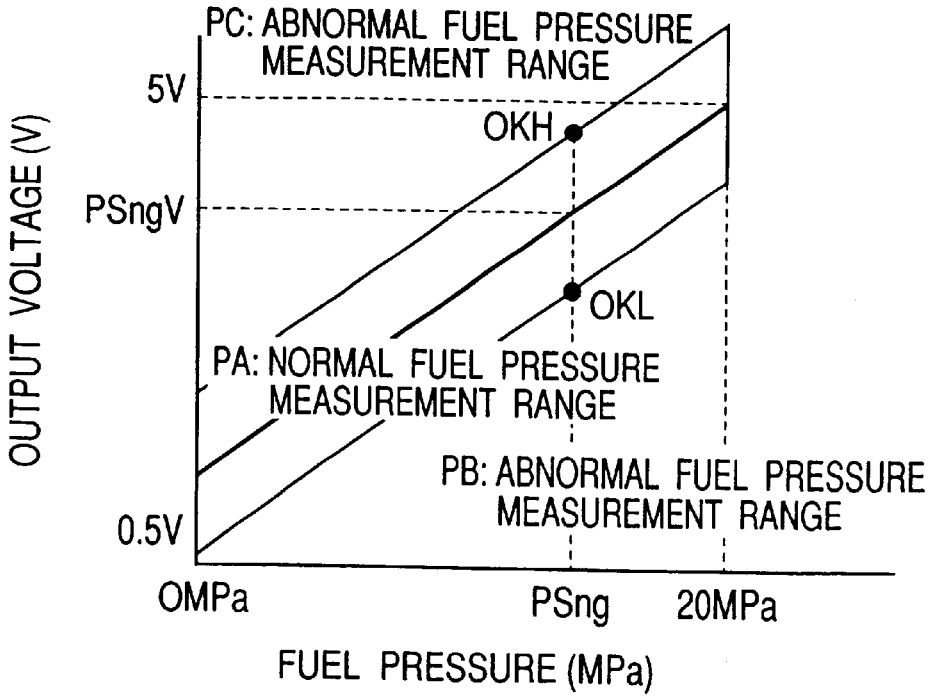
FIG. 25 shows an example of operation characteristics of a fuel pressure sensor used in the fuel supply system shown in FIG. 2.

At step 244, an abnormality judgement of the fuel pressure sensor is performed while checking whether the output voltage of the fuel pressure sensor measured at step 243 is within a predetermined fuel pressure range determined by the fixed control duty of the electrically controlled pressure regulator. Namely, it is judged whether the output voltage $V_{fuel}$ of the fuel pressure sensor measured at step 243 is within an output voltage range of the fuel pressure sensor corresponding to a fuel pressure range in the fuel pipeline when the control duty of the electrically controlled pressure regulator is fixed at 0%. At step 244, when the output voltage $V_{fuel}$ of the fuel pressure sensor is within the predetermined output voltage range of the fuel pressure sensor, namely, within the range from the lower output voltage limit OKL to the upper output voltage limit OKH as shown in FIG. 25, it is judged whether the above condition continues more than a predetermined time interval $T_{vfl}1$ at step 245, and if the answer is no, the process goes to step 246 and keeps setting both the fuel supply system abnormality flag and the fuel pressure sensor abnormality flag at 1. On the other hand, if the answer at step 245 is yes, both the fuel supply system abnormality flag and the fuel pressure sensor abnormality flag are cleared to 0 at step 247.

Contrary, if the output voltage $V_{fuel}$ of the fuel pressure sensor is outside the predetermined output voltage range of the fuel pressure sensor, namely above the upper output voltage limit OKH or below the lower output voltage limit OKL of the fuel pressure sensor at step 244, it is judged whether such condition continues more than a predetermined time interval $T_{vfl}2$ at step 248. If the answer at step 248 is no, both the fuel supply system abnormality flag and the fuel pressure sensor abnormality flag are kept setting at 1 at step 249. On the other hand, if the answer at step 248 is yes, the fuel pressure Pf is set at a predetermined control fuel pressure NGPf which is generated when the control duty of the electrically controlled pressure regulator is fixed, for example, at 0% without using fuel pressure signals outputted from the failed fuel pressure sensor so as to maintain an operable condition of the engine. Thereafter, at step 240*a* an alarm lamp is turned on to inform the failure to the driver, and the fuel pressure sensor abnormality flag is kept setting at 1. Further, the upper output voltage limit OKH and the lower output voltage limit OKL of the fuel pressure sensor are determined according to a relation between fuel pressure in the fuel pipeline and output voltage of the fuel pressure sensor as illustrated in FIG. 25.

More specifically, if the measured output voltage $V_{fuel}$ of the fuel pressure sensor is within the upper and lower output voltage limits of the fuel pressure sensor, it is judged that the fuel pressure sensor is normal, and the both abnormality flags are cleared and the control at the time of normal condition is continued. On the other hand, if the measured output voltage $V_{fuel}$ of the fuel pressure sensor is outside the upper and lower output voltage limits of the fuel pressure sensor, it is judged that the fuel pressure sensor is abnormal, and the control at the abnormal condition as has been explained in connection with FIG. 24 is performed.

Variations of output voltage $V_{fuel}$ of the fuel pressure sensor, control duty $PF_{duty}$ of the electrically controlled pressure regulator, air/fuel ratio feed back control amount ALPHA and A/F, when the fuel pressure sensor is judged abnormal, are explained with reference to FIGS. 25 and 26.

How a failure of the fuel pressure sensor is judged based on the output signals from the fuel pressure sensor is explained with reference to FIG. 25. The portion enclosed by a solid frame in the drawing shows a normal operating region the fuel pressure sensor. On the other hand, the region other than the framed region represents abnormal region where the measured values show abnormality. When the fuel pressure sensor is judged abnormal, the control duty $PF_{duty}$ of the electrically controlled pressure regulator is fixed at a predetermined value, for example, 0% or full control amount, resultantly, the fuel pressure in the fuel pipeline assumes PSng. Therefore, if the fuel pressure sensor restores normal at that moment, the output voltage of the fuel pressure sensor will be within the lower output voltage limit OKL and the upper output voltage limit OKH of the fuel pressure sensor as shown in FIG. 25. However, the fuel pressure sensor is failed, the output voltage of the fuel pressure sensor will be outside the upper and lower limits, thereby, a failure of the fuel pressure sensor is judged. In such instance, the fuel pressure PSng is used as the fuel pressure in the fuel pipeline for the engine control during the abnormal time of the fuel pressure sensor.

Figure 26:
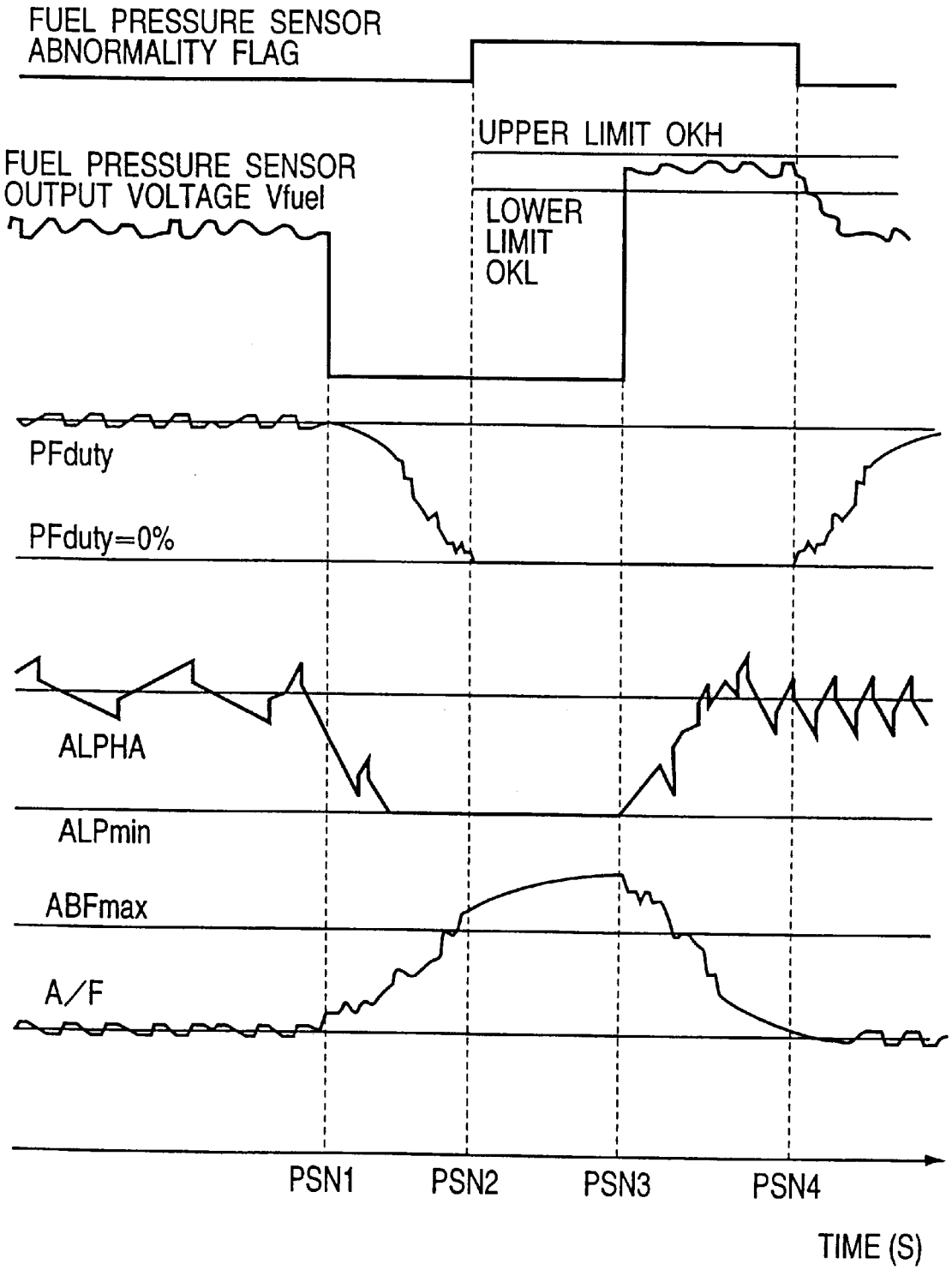
FIG. 26 is a diagram for explaining behaviors when a fuel pressure sensor becomes abnormal and behaviors when the same being restored to a normal condition thereafter.

FIG. 26 shows behaviors of several control elements when the fuel pressure sensor is momentarily disconnected, for example, in sufficient contact of its connector occurs. When assuming that at the moment PSN1 a disconnection of the fuel pressure sensor due to insufficient contact of the connector occurs, the output voltage of the fuel pressure sensor suddenly drops. In response to the sudden drop of the output voltage of the fuel pressure sensor, the fuel pressure feed back control in the fuel supply system functions to control the control duty of the electrically controlled pressure regulator so as to raise the fuel pressure. However, the fuel injection pulse width is calculated based on the output of the fuel pressure sensor, the actual air/fuel ratio deviates greatly from the target air/fuel ratio as well as the air/fuel ratio feed back control amount ALPHA also deviates greatly from the mean value thereof, and therefore, at the timing PSN2 an abnormality of the fuel pressure sensor is judged. Thereafter, if the disconnection of the fuel pressure sensor due insufficient contact of the connector is recovered at the moment PSN3, the output voltage of the fuel pressure sensor restores to the predetermined range, and the fuel pressure sensor is judge normal at the moment PSN4, therefore, the fuel pressure sensor abnormality flag is cleared and the normal engine control resumes.

The embodiments of the present invention as has been explained hitherto are provided with the means for diagnosing abnormality in the fuel supply system when the fuel pressure detected by the means for detecting fuel pressure in the fuel supply system for the internal combustion engine is judged to be outside a predetermined range determined by a control amount of the means for controlling the fuel pressure in the fuel supply system; means for specifying a possible abnormal element in the fuel supply system either by determining whether an actual air/fuel ratio detected by the means for detecting actual air/fuel ratio of the internal combustion engine is within a predetermined target air/fuel ratio range determined based on the operating conditions of the internal combustion engine or by determining whether an actual air/fuel ratio feed back control amount is within a predetermined range thereof; means for maintaining operation of the internal combustion engine by setting the control duty of the fuel pressure control means at either zero or full control amount when the fuel pressure control means is judged abnormal; means for varying alternatively between large and small two control duties of the fuel pressure control means when fuel pressure control means is judged abnormal and for judging as normal when no abnormality of the fuel pressure control means is detected any more; means for maintaining operation of the internal combustion engine by using a fuel pressure determined by a predetermined control duty such as zero and full control amount of the fuel pressure control means as the signal from the fuel pressure detecting means for the control of the internal combustion engine when the fuel pressure detecting means is judged abnormal; and means for judging normality of the fuel pressure detecting means after being once judged as abnormal by determining the fuel pressure detected by the fuel pressure detecting means being within a predetermined range determined by a predetermined duty such as zero and full control amount of the fuel pressure control means.

Hereinabove, embodiments according to the present invention have been explained. However, the present invention is not limited to such embodiments but can be modified in a variety of manners to the extent not deviating from the gist of the present invention.

For example, in case of deviation of air/fuel ratio due to failure of the fuel pressure sensor, under a condition where the signals of an air/fuel sensor stick to a lean state the air/fuel ratio is moved to a rich state by increasing the fuel injection pulse width. On the other hand, under a condition where the signals of the air/fuel sensor stick to a rich state, the air/fuel ratio is moved to a lean state by decreasing the fuel injection pulse width, thereby an operation of the engine is maintained.

Alternatively, in case of deviation of air/fuel ratio due to failure of a fuel pressure sensor, under a condition where the signals of an air/fuel sensor stick to a lean state the air/fuel ratio is moved to a rich state by controlling a throttle valve into closing direction. On the other hand, under a condition where the signals of the air/fuel sensor stick to a rich state, the air/fuel ratio is moved to a lean state by controlling the throttle valve into opening direction, thereby an operation of the engine is maintained.

According to the present invention, a failure in a fuel supply system can be judged before such failure actually affects a driving performance of an internal combustion engine as well as through rediagnosis and cleaning control, possibility of erroneous parts exchange is reduced, thereby a failure diagnosis of a fuel supply system with minimum erroneous judgement is realized.

Further, during an abnormal state, the internal combustion engine can be controlled with means different from those for a normal control.

What is claimed is:

1. A control arrangement for an internal combustion engine which comprises a fuel supply system for supplying and injecting a high pressure fuel into the internal combustion engine and including a high pressure fuel pump, an electrically controlled pressure regulator and a fuel pressure sensor which are disposed along a fuel supply line from a fuel tank to a fuel injection valve; and an air/fuel ratio control system including means for determining a target air/fuel ratio for the internal combustion engine in response to an operating condition of the internal combustion engine, an air/fuel ratio sensor for detecting air/fuel ratio of the internal combustion engine, and an air/fuel ratio feed back control means for feeding back a control amount determined in relation to a deviation between the determined target air/fuel ratio and the detected air/fuel ratio, and which control arrangement further comprises an abnormality diagnosis means which diagnoses a possible abnormality in said fuel supply system, when the pressure of the pressurized fuel in said fuel supply system detected by said fuel pressure sensor exceeds predetermined upper and lower limits determined by a control duty for said electrically controlled pressure regulator; and an abnormal element decision means which decides an abnormal element in said fuel supply system at least an abnormality either in said fuel pressure sensor or in said electrically controlled pressure regulator based on an amount representing an air/fuel ratio status including the actual air/fuel ratio and the air/fuel ratio feed back control amount extracted from said air/fuel ratio control system for the internal combustion engine, when said abnormality diagnosis means diagnoses an abnormality in said fuel supply system.

2. A control arrangement for an internal combustion engine according to claim 1, wherein said abnormality diagnosis means diagnoses an abnormality in said fuel supply system when the pressurized fuel pressure in said fuel supply system detected by said fuel pressure sensor exceeds the predetermined upper or lower limit for a predetermined first period ($T_{pf}$).

3. A control arrangement for an internal combustion engine according to claim 2, wherein when said abnormality diagnosis means diagnoses an abnormality in said fuel supply system, said abnormal element decision means decides an abnormality in said electrically controlled pressure regulator when the amount representing an air/fuel ratio status including an actual air/fuel ratio and an air/fuel ratio feed back control amount provided from said air/fuel ratio control system for the internal combustion engine remains within a predetermined upper and lower limits extracted from the target air/fuel ratio for a second predetermined period ($T_{abf}1$), and decides an abnormality in said fuel pressure sensor when the amount representing the air/fuel ratio status remains outside the predetermined upper and lower limits for a third predetermined period ($T_{abf}2$).

4. A control arrangement for an internal combustion engine according to claim 3, further comprising means for driving said electrically controlled pressure regulator through alternate application of two greatly separated control duties for a predetermined time when said abnormal element decision means decides an abnormality in said electrically controlled pressure regulator, and means for setting the control duty of said electrically controlled pressure regulator at a fixed value either at 0% or 100% and for deciding and displaying a failure in said electrically controlled pressure regulator even after said electrically controlled pressure regulator is driven by said driving means with alternate control duties for the predetermined times and said abnormal element decision means again decides an abnormality in said electrically controlled pressure regulator.

5. A control arrangement for an internal combustion engine according to claim 3, further comprising means for fixing the control duty of said electrically controlled pressure regulator at a predetermined control duty when said abnormal element decision means decides an abnormality in said fuel pressure sensor, for canceling abnormality decision of the fuel pressure sensor when the fuel pressure of said fuel pressure sensor remains within the predetermined upper and lower limits determined by the fixed control duty of said electrically controlled pressure regulator for a fourth predetermined period ($T_{vfl}1$), and for setting the fuel pressure from said fuel pressure sensor at a predetermined fixed valve (NGPf) when the fuel pressure of said fuel pressure sensor remains outside of the predetermined upper and lower limits for fifth predetermined period ($T_{vfl}2$) and for deciding and displaying a failure of said fuel pressure sensor.

6. A control arrangement for an internal combustion engine according to claim 1, wherein the control duty of said electrically controlled pressure regulator is determined by a target control duty determined depending on the operating conditions of the internal combustion engine and a fuel pressure feed back control amount determined based on a deviation between a target fuel pressure of said fuel supply system determined depending on the operating condition of the internal combustion engine and an actual fuel pressure of said fuel supply system detected by said fuel pressure sensor.

* * * * *